US011287148B2

(12) United States Patent
Zhang et al.

(10) Patent No.: US 11,287,148 B2
(45) Date of Patent: Mar. 29, 2022

(54) AIR CONDITIONER, CONTROL STRATEGY OF THE AIR CONDITIONER, AND AIR CONDITIONING SYSTEM

(71) Applicant: ZHEJIANG SANHUA INTELLIGENT CONTROLS CO., LTD., Shaoxing (CN)

(72) Inventors: Peilan Zhang, Shaoxing (CN); Longzhong Huang, Shaoxing (CN); Bin Yin, Shaoxing (CN); Lin-Jie Huang, Shaoxing (CN); Chunyou Zhou, Shaoxing (CN)

(73) Assignee: ZHEJIANG SANHUA INTELLIGENT CONTROLS CO., LTD., Shaoxing (CN)

( * ) Notice: Subject to any disclaimer, the term of this patent is extended or adjusted under 35 U.S.C. 154(b) by 125 days.

(21) Appl. No.: 16/760,441

(22) PCT Filed: Oct. 29, 2018

(86) PCT No.: PCT/CN2018/112456
§ 371 (c)(1),
(2) Date: Apr. 29, 2020

(87) PCT Pub. No.: WO2019/085864
PCT Pub. Date: May 9, 2019

(65) Prior Publication Data

US 2021/0180808 A1 Jun. 17, 2021

(30) Foreign Application Priority Data

Oct. 30, 2017 (CN) ..... 201711034636.8
Oct. 30, 2017 (CN) ..... 201711034682.8
(Continued)

(51) Int. Cl.
*F25B 13/00* (2006.01)
*F24F 5/00* (2006.01)
(Continued)

(52) U.S. Cl.
CPC ..... *F24F 5/001* (2013.01); *F25B 13/00* (2013.01); *F24F 1/027* (2013.01); *F24F 11/84* (2018.01);
(Continued)

(58) Field of Classification Search
CPC .. F24F 5/001; F24F 5/00; F24F 5/0021; F24F 1/02; F24F 1/027; F24F 11/84;
(Continued)

(56) References Cited

U.S. PATENT DOCUMENTS

2008/0034760 A1* 2/2008 Narayanamurthy .. F24F 5/0017 62/59
2016/0258636 A1* 9/2016 Kim ..... F24F 1/22
(Continued)

FOREIGN PATENT DOCUMENTS

CN 2604649 Y 2/2004
CN 202420029 U 9/2012
(Continued)

*Primary Examiner* — Henry T Crenshaw
*Assistant Examiner* — Kamran Tavakoldavani
(74) *Attorney, Agent, or Firm* — Cheng-Ju Chiang

(57) ABSTRACT

The present disclosure provides an air conditioner, a control strategy of the air conditioner and an air conditioning system. The air conditioner includes a compressor, a first heat exchanger, a phase-change thermal-storage heat exchanger, a throttling device and a box. The throttling device is provided between the first heat exchanger and the phase-change thermal-storage heat exchanger. One of the first heat exchanger and phase-change thermal-storage heat exchanger functions as an evaporator and the other functions as a condenser. The box includes an air supply port and an
(Continued)

air return port. The compressor, the first heat exchanger, the phase-change thermal-storage heat exchanger and the throttling device are mounted in the box, thereby facilitating installation of the air conditioner.

20 Claims, 20 Drawing Sheets

(30) Foreign Application Priority Data

| | | |
|---|---|---|
| Oct. 30, 2017 | (CN) | 201711034780.1 |
| Oct. 30, 2017 | (CN) | 201711036009.8 |
| Oct. 30, 2017 | (CN) | 201711037820.8 |
| Oct. 30, 2017 | (CN) | 201711042801.4 |
| Oct. 30, 2017 | (CN) | 201721417978.3 |
| Oct. 30, 2017 | (CN) | 201721418352.4 |

(51) Int. Cl.

| | |
|---|---|
| *F24F 11/84* | (2018.01) |
| *F24F 110/10* | (2018.01) |
| *F24F 1/027* | (2019.01) |
| *F24F 13/30* | (2006.01) |

(52) U.S. Cl.
CPC ..... *F24F 13/30* (2013.01); *F24F 2110/10* (2018.01); *F25B 2313/02741* (2013.01)

(58) Field of Classification Search
CPC ..... F24F 13/30; F24F 2110/10; F24F 2005/0025; F24F 2120/10; F24F 2120/12; F25B 13/00; F25B 39/04; F25B 41/38; F25B 2313/02741; F25B 2339/042; F25B 2700/2111; F25B 2700/2104; F25B 2700/21173; F25B 2600/01; F28D 20/02; F28F 27/00; Y02E 60/14
USPC ..... 62/160
See application file for complete search history.

(56) References Cited

U.S. PATENT DOCUMENTS

| | | | | |
|---|---|---|---|---|
| 2016/0313013 | A1* | 10/2016 | Chaudhry | F24F 1/027 |
| 2020/0116374 | A1* | 4/2020 | Tashiro | F25B 47/022 |

FOREIGN PATENT DOCUMENTS

| | | | |
|---|---|---|---|
| CN | 103206807 | A | 7/2013 |
| CN | 103423815 | A | 12/2013 |
| CN | 103629859 | A | 3/2014 |
| CN | 104279667 | A | 1/2015 |
| CN | 104566649 | A | 4/2015 |
| CN | 104633841 | A | 5/2015 |
| CN | 104913415 | A | 9/2015 |
| CN | 105371500 | A | 3/2016 |
| CN | 106642455 | A | 5/2017 |
| CN | 106642457 | A | 5/2017 |
| CN | 207555795 | U | 6/2018 |
| CN | 207797227 | U | 8/2018 |
| DE | 2523429 | A1 | 12/1976 |
| EP | 2932166 | B1 | 6/2017 |
| JP | H9-119723 | A | 5/1997 |
| JP | H10-238892 | A | 9/1998 |
| JP | H11-94296 | A | 4/1999 |

* cited by examiner

AIR CONDITIONER, CONTROL STRATEGY OF THE AIR CONDITIONER, AND AIR CONDITIONING SYSTEM

CROSS-REFERENCE TO RELATED APPLICATIONS

This application is a 35 U.S.C. § 371 National Phase conversion of International (PCT) Patent Application No. PCT/CN2018/112456, entitled "Air Conditioner, Control Strategy of the Air Conditioner, And Air Conditioning System", filed on Oct. 29, 2018, which claims priorities of Zhejiang Sanhua Intelligent Controls Co., Ltd., filed on Oct. 30, 2017 with an invention title of "Ceiling-mounted Air Conditioner" and a Chinese Patent Application No. "201711037820.8", an invention title of "Embedded Air Conditioner" and a Chinese Patent Application No. "201711034682.8", an invention title of "Wall-mounted Air Conditioner" and a Chinese Patent Application No. "201721418352.4", an invention title of "Desktop Air Conditioner" and a Chinese Patent Application No. "201721417978.3", an invention title of "Air Conditioning System and Air Conditioner" and a Chinese Patent Application No. "201711034636.8", an invention title of "Air Conditioning System and Air Conditioner" and a Chinese Patent Application No. "201711042801.4", an invention title of "Air Conditioning System and Air Conditioner" and a Chinese Patent Application No. "201711036009.8", an invention title of "Air Conditioner and Control Strategy of the Air Conditioner" and a Chinese Patent Application No. "201711034780.1", the entire contents of which are incorporated herein by reference. The PCT International Patent Application was filed and published in Chinese.

TECHNICAL FIELD

The present disclosure belongs to a field of air conditioning technology, and in particular, it relates to an air conditioner, a control strategy of the air conditioner and an air conditioning system.

BACKGROUND

The air conditioner usually adopts a split structure including an indoor unit and an outdoor unit, which not only occupies a certain outdoor space, but also requires a separate arrangement, and the assembly process is complicated. At the same time, when the air conditioner in the related art provides cold or heat to the indoor space, it will release heat or cold to the outside, which will affect ambient temperature.

SUMMARY

The present disclosure proposes an air conditioner.

The air conditioner according to the present disclosure includes a compressor, a first heat exchanger, a phase-change thermal-storage heat exchanger, a throttling device and a box. One of a first end of the first heat exchanger and a first end of the phase-change thermal-storage heat exchanger is communicated with an outlet of the compressor, and the other of the first end of the first heat exchanger and the first end of the phase-change thermal-storage heat exchanger is communicated with an inlet of the compressor. The throttling device is provided between a second end of the first heat exchanger and a second end of the phase-change thermal-storage heat exchanger. The box includes an air supply port and an air return port. The compressor, the first heat exchanger, the phase-change thermal-storage heat exchanger and the throttling device are mounted in the box.

BRIEF DESCRIPTION OF DRAWINGS

The above and/or additional aspects and advantages of the present disclosure will become apparent and easily understood from the description of the embodiments in conjunction with the following drawings, in which.

Figure 1:
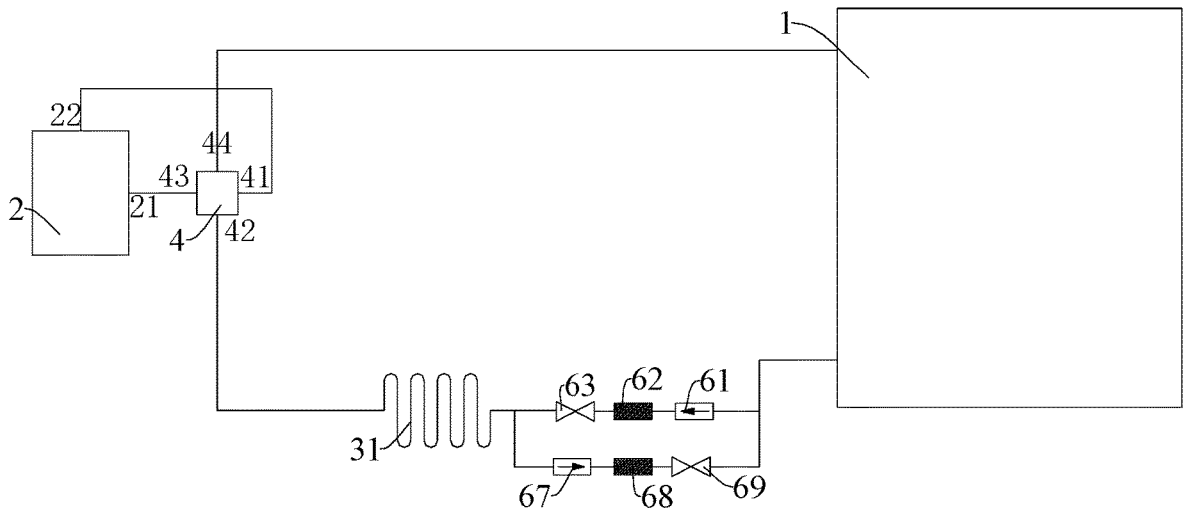
FIG. 1 is a schematic diagram of an air conditioner according to an embodiment of the present disclosure.

REFERENCE SIGNS phase-change thermal-storage heat exchanger 1, packaging container 11, casing 111, upper cover 112, phase change medium 12, distance sensor 13, compressor 2, inlet 21, outlet 22, first heat exchanger 31, second heat exchanger 32, water tank 33, reversing unit 4, first port 41, second port 42, third port 43, fourth port 44, box 5, box body 51, top cover 52, lug 53, air supply port 54, air return port 55, handle portion 56, first check valve 61, first drying filter 62, first throttling element 63, second check valve 64, second drying filter 65, second throttling element 66, third check valve 67, third drying filter 68, third throttling element 69, first shut-off valve 71, second shut-off valve 72, third shut-off valve 73;

temperature sensor 81, human body sensor 82.

DETAILED DESCRIPTION

The air conditioner of an embodiment of the present disclosure can be a ceiling-mounted air conditioner.

The ceiling-mounted air conditioner according to the embodiment of the present disclosure will be described below with reference to FIGS. 1 to 6. The ceiling-mounted air conditioner can be used in an indoor environment, such as a kitchen etc.

As shown in FIGS. 1 to 6, the ceiling-mounted air conditioner according to the embodiment of the present disclosure includes a compressor 2, a first heat exchanger 31, a phase-change thermal-storage heat exchanger 1, a throttling device and a box 5.

The box 5 has an air supply port 54 and an air return port 55. The box 5 is adapted for being mounted on a roof. For example, when the ceiling-mounted air conditioner is a kitchen air conditioner, the ceiling-mounted air conditioner has two layouts: when the kitchen has a ceiling, the box 5 can be installed in the ceiling; and when the kitchen does not have a ceiling, the box 5 can be directly mounted and fixed to a roof.

Neither of these two layouts takes up extra space in the kitchen. Therefore, it is highly decorative with no exposed pipelines necessary in decoration, and it does not affect aesthetics. In order to match with the ceiling in the kitchen, the box 5 is mainly of a flat cuboid shape so that the height of the box 5 is capable of meeting the height of the ceiling.

The compressor 2, the first heat exchanger 31, the phase-change thermal-storage heat exchanger 1 and the throttling device are all disposed in the box 5, and refrigeration system pipes are laid in the box 5 as well. In other words, the ceiling-mounted air conditioner has an integrated structure of which the overall structure is more compact. There is no need to separately install an indoor unit and an outdoor unit, which facilitates the installation.

The compressor 2, the phase-change thermal-storage heat exchanger 1, the throttling device and the first heat exchanger 31 are communicated to form a refrigerant circuit. The compressor 2, the phase-change thermal-storage heat exchanger 1, the throttling device and the first heat exchanger 31 are capable of being communicated with each other through copper pipes.

The first heat exchanger 31 is provided between the air supply port 54 and the air return port 55. During work, air enters and leaves the box 5 through the air return port 55 and the air supply port 54 respectively, and exchanges heat with the first heat exchanger 31 to achieve indoor air temperature adjustment. For example, the first heat exchanger 31 may be an air-cooled heat exchanger. A blower can be provided to draw outside air into the box 5, exchange heat with the refrigerant in the first heat exchanger 31, and blow it into an indoor room from the air supply port 54.

The position of the air supply port 54 can be designed according to the installation position of the ceiling-mounted air conditioner and the standing position of a people cooking in the kitchen, so that the human body is shrouded in the cooling area, which can better eliminate the heat sensation during cooking.

The compressor 2 has an outlet 22 and an inlet 21. The heat-exchanged refrigerant can enter the compressor 2 from the inlet 21, and the refrigerant can be discharged from the outlet 22 after being compressed by the compressor 2. It should be noted that the structure and working principle of the compressor 2 are well known to those skilled in the art, therefore it will not be described in detail here.

Referring to FIG. 1, the refrigerant circuit of the ceiling-mounted air conditioner is described below. Specifically, one of a first end (for example, a left end shown in FIG. 1) of the first heat exchanger 31 and a first end (for example, an upper end shown in FIG. 1) of the phase-change thermal-storage heat exchanger 1 may be communicated with the outlet 22, and the other of the first end of the first heat exchanger 31 and the first end of the phase-change thermal-storage heat exchanger 1 is communicated with the inlet 21. The throttling device may be provided at a second end (for example, a right end shown in FIG. 1) of the first heat exchanger 31 and a second end (for example, a lower end shown in FIG. 1) of the phase-change thermal-storage heat exchanger 1. That is, the second end of the first heat exchanger 31 and the second end of the phase-change thermal-storage heat exchanger 1 may be communicated with two ends of the throttling device, respectively.

When the refrigerant flows through the first heat exchanger 31, it performs heat exchange with air to achieve the purpose of cooling or heating. After the refrigerant enters the phase-change thermal-storage heat exchanger 1, it can exchange heat with the phase change medium in the phase-change thermal-storage heat exchanger 1. After the phase change medium absorbs or releases heat, it realizes the storage and release of heat through the change of its phase state. In the meanwhile, the refrigerant does not need to exchange heat with the environment after heat exchange in the phase-change thermal-storage heat exchanger 1, which makes the ceiling-mounted air conditioner unnecessarily to release heat to the environment during cooling, and unnecessarily to absorb heat from the environment during heating. As a result, the integrated structure of the ceiling-mounted air conditioner can be realized, which breaks the tradition of the split structure of the traditional air conditioner.

For example, when the inlet 21 is communicated with the first end of the first heat exchanger 31 and the outlet 22 is communicated with the first end of the phase-change thermal-storage heat exchanger 1, the ceiling-mounted air conditioner can provide users with cooling capacity. The high-temperature and high-pressure gaseous refrigerant discharged from the outlet 22 can firstly flow to the phase-change thermal-storage heat exchanger 1. The refrigerant exchanges heat with the phase change medium in the phase-change thermal-storage heat exchanger 1 to form a liquid refrigerant and then flows to the throttling device from the phase-change thermal-storage heat exchanger 1. After the throttling device throttles and reduces pressure, the refrigerant forms a low-temperature and low-pressure refrigerant and flows to the first heat exchanger 31. The refrigerant exchanges heat with the air in the first heat exchanger 31 to provide the user with cooling capacity and form a gaseous refrigerant, and then the refrigerant returns to the compressor 2 from the inlet 21.

Accordingly, when the inlet 21 is communicated with the first end of the phase-change thermal-storage heat exchanger 1 and the outlet 22 is communicated with the first end of the first heat exchanger 31, the ceiling-mounted air conditioner can provide users with heating capacity.

The ceiling-mounted air conditioner according to the embodiment of the present disclosure does not need to release heat to the environment during cooling, and does not need to absorb heat from the environment during heating. Therefore, it is capable of realizing an integrated design and being installed on the roof without taking up extra space in the kitchen and with good decoration.

In some preferred embodiments of the present disclosure, as shown in FIGS. 2 to 6, the box 5 may be of a cuboid shape. A length, a width and a height of the box 5 are a, b and c, respectively, and the following condition is satisfied: $a \geq b \geq 2c$, furthermore, $a \geq b \geq 5c$. A top wall where a long side and a wide side are located is adapted for being mounted to the roof. That is, the box 5 may be of a flat cuboid shape so that the height of the box 5 meets the height of the kitchen ceiling.

As shown in FIG. 2 to FIG. 5, the box 5 includes a box body 51 with a top opening and a top cover 52 that closes the top opening of the box body 51. In other words, an upper side of the box body 51 is opened, and the top cover 52 is mounted to the upper side of the box body 51. The top cover 52 may be mounted to the roof. The top cover 52 is directly opposite to a bottom wall of the box body 51. The bottom wall of the box body 51 is a surface of the ceiling-mounted air conditioner mounted on the roof and facing the ground. Edges of the top cover 52 are provided with a plurality of lugs 53 for connecting with the roof, and the lugs 53 may be provided with mounting holes for connecting with the roof. Preferably, four edges of the top cover 52 are provided with the lugs 53, respectively, and the lugs 53 are provided with mounting holes. For example, the long sides of the top cover 52 are respectively provided with two longer lugs 53 of which each is provided with two mounting holes. The short sides of the top cover 52 of which each is provided with one shorter lugs 53 with one mounting hole.

Figure 2:
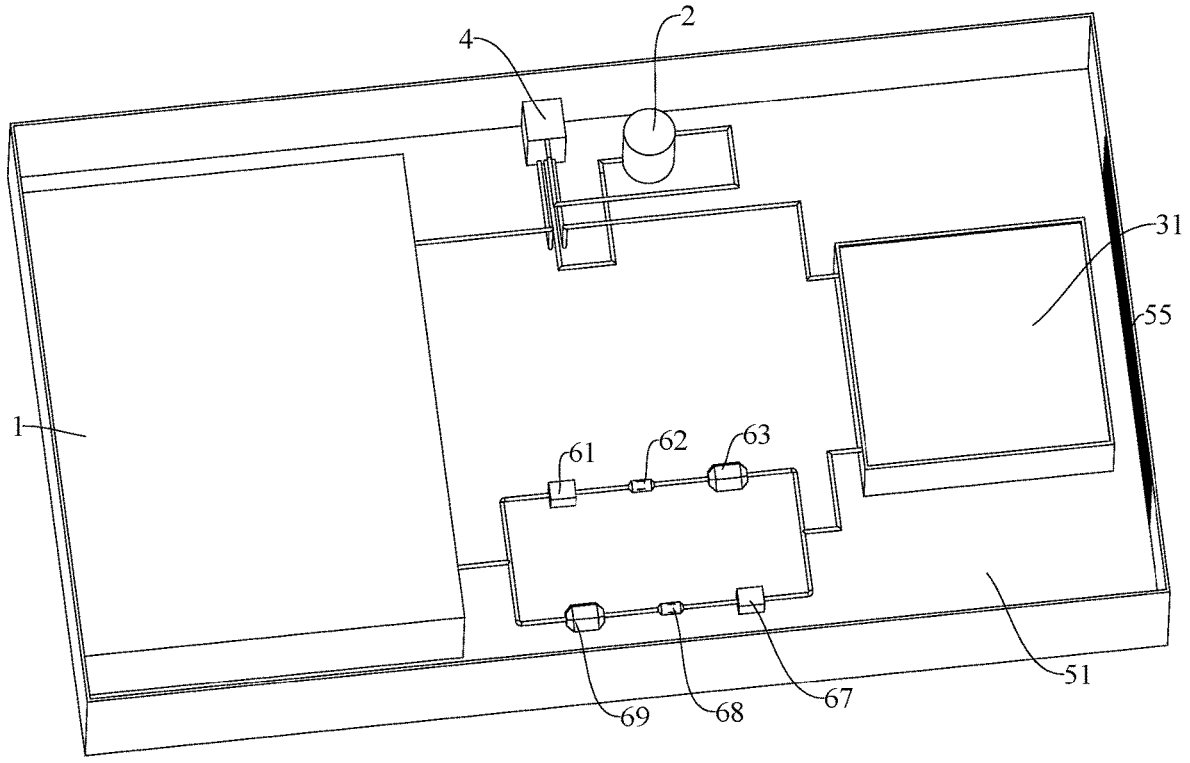
FIGS. 2 to 6 are schematic structural diagrams of a ceiling-mounted air conditioner according to an embodiment of the present disclosure.
Figure 5:
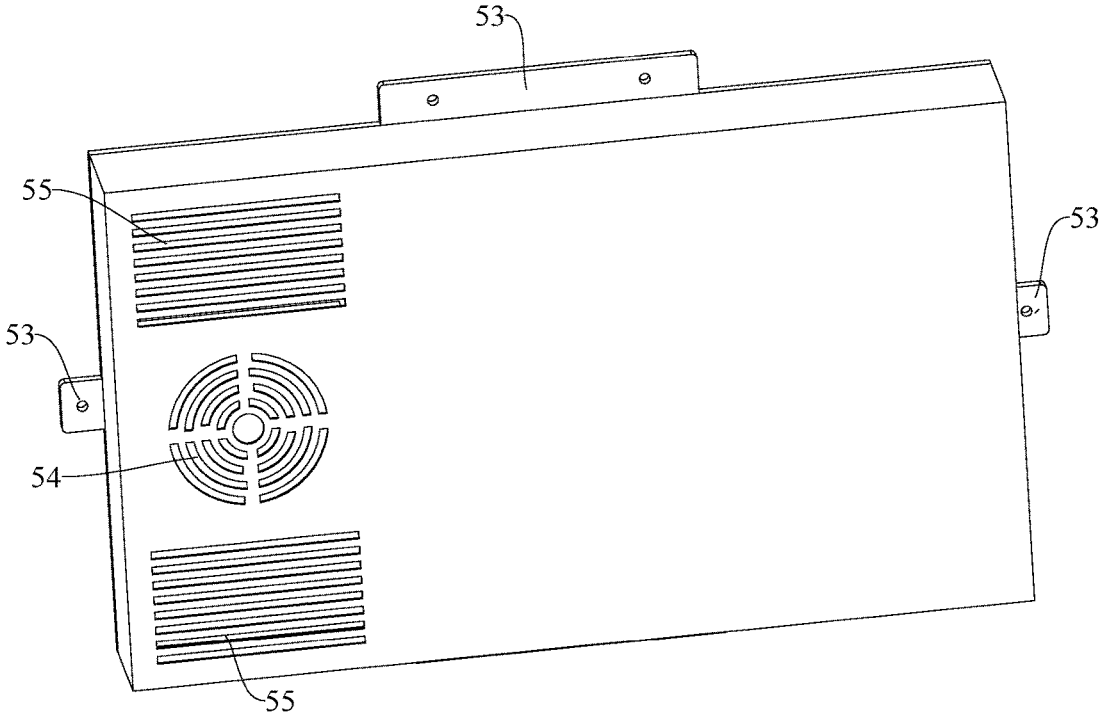
Figure 6:
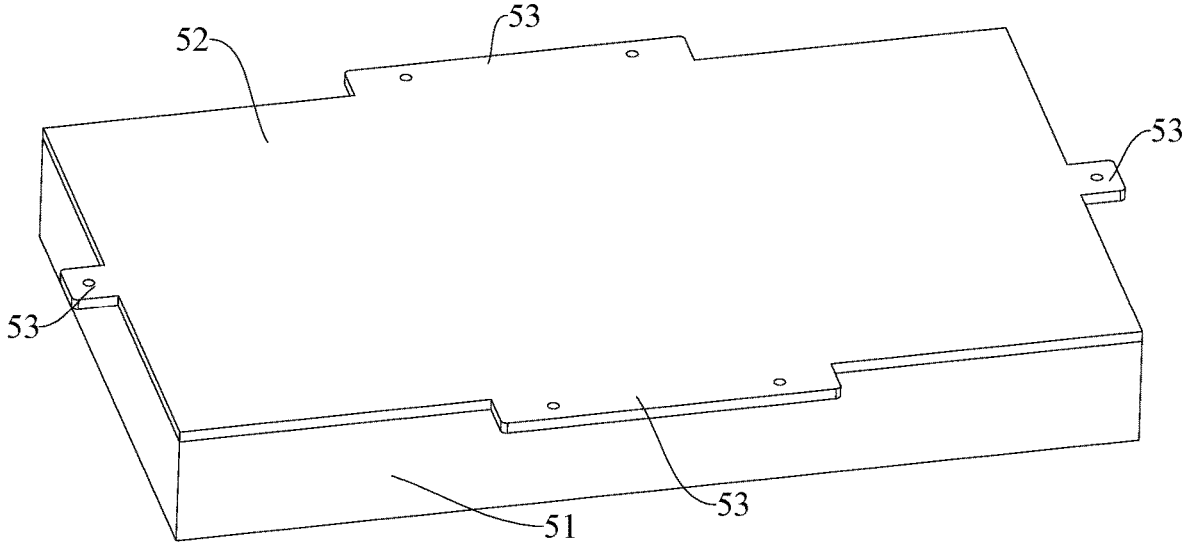
Figure 7:
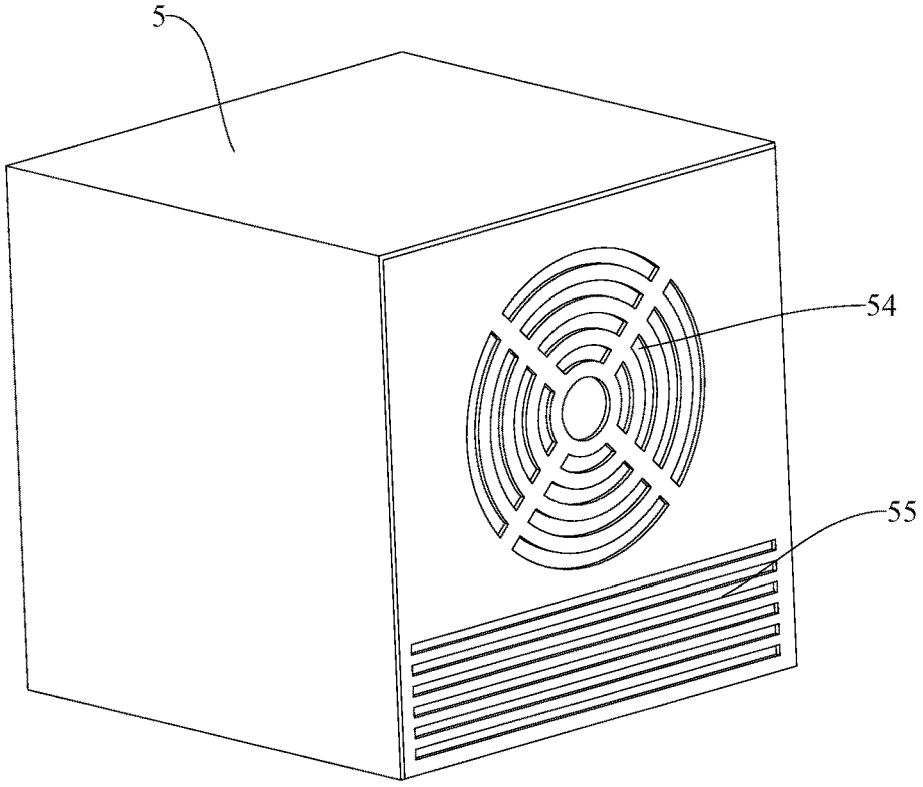
FIGS. 7 to 10 are schematic structural diagrams of an embedded air conditioner according to an embodiment of the present disclosure.

There are various options for the form of the supply air and the return air. For example, as shown in FIG. 2, the air supply port 54 is provided at the bottom wall of the box body 51, and the air return port 55 is provided at the side wall of the box body 51. The air supply port 54 is located above a standing position of the cooking people in the kitchen. The human body is shrouded in the cooling area, which can better eliminate the heat sensation during cooking. This form is suitable for the occasion where the kitchen does not have a ceiling or a partial ceiling. Alternatively, as shown in FIG. 5, both the air supply port 54 and the air return port 55 are provided at the bottom wall of the box body 51. This way is suitable regardless of whether the kitchen has a ceiling. Alternatively, the air supply port 54 is provided at the side wall of the box body 51, and the air return port 55 is provided at the bottom wall of the box body 51. In this way, there is a certain horizontal distance between the air supply port 54 and the standing position of the person. As a result, the air vent can be far away from the oil fume area, which has certain benefits for maintaining good cleanliness. This form is suitable for occasions where the kitchen does not have a ceiling or a partial ceiling. Alternatively, both the air supply port 54 and the air return port 55 are provided at the side wall of the box body 51.

In the above embodiments, indoor air is circulated, that is, the indoor air is used for the return air, which will cause oil fume to affect the heat exchanger to a certain extent, degrade the heat transfer, and make the return air with fume smell. In order to overcome this drawback, a direct air conditioning system can be used, that is, an air duct is arranged in the ceiling, and the outdoor air is used for the return air. For example, the air supply port 54 is provided at the bottom wall or the side wall of the box body 51, and the air return port 55 is adapted for being communicated with the outdoor through the air duct. The air return port 55 may be provided at the top cover 52, the air duct is arranged in the ceiling, and the outdoor air is used for returning air.

The shape of the air supply port 54 may be rectangular or circular etc. The shape of the air return port 55 may be rectangular or circular etc.

At least one of the air supply port 54 and the air return port 55 is detachable, which is convenient for cleaning.

Figure 3:
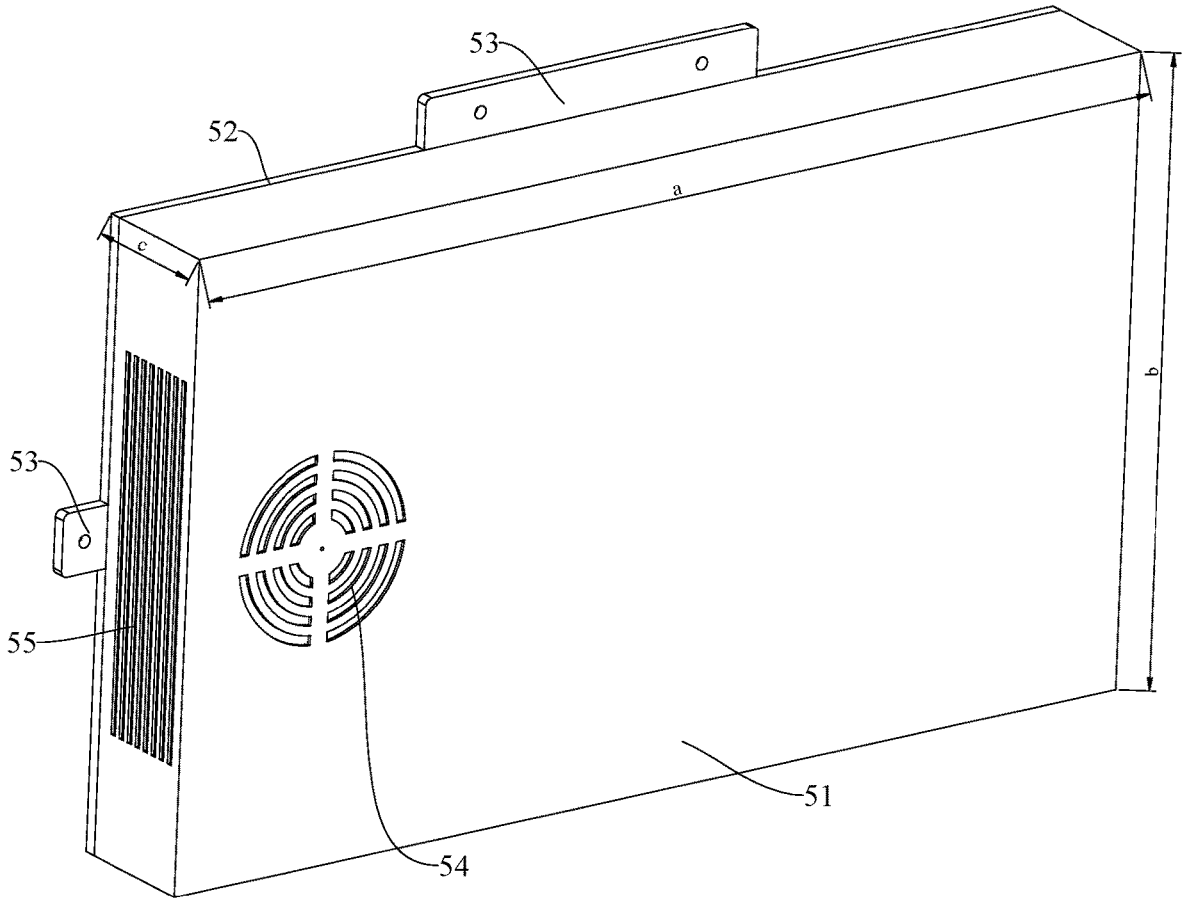
Figure 4:
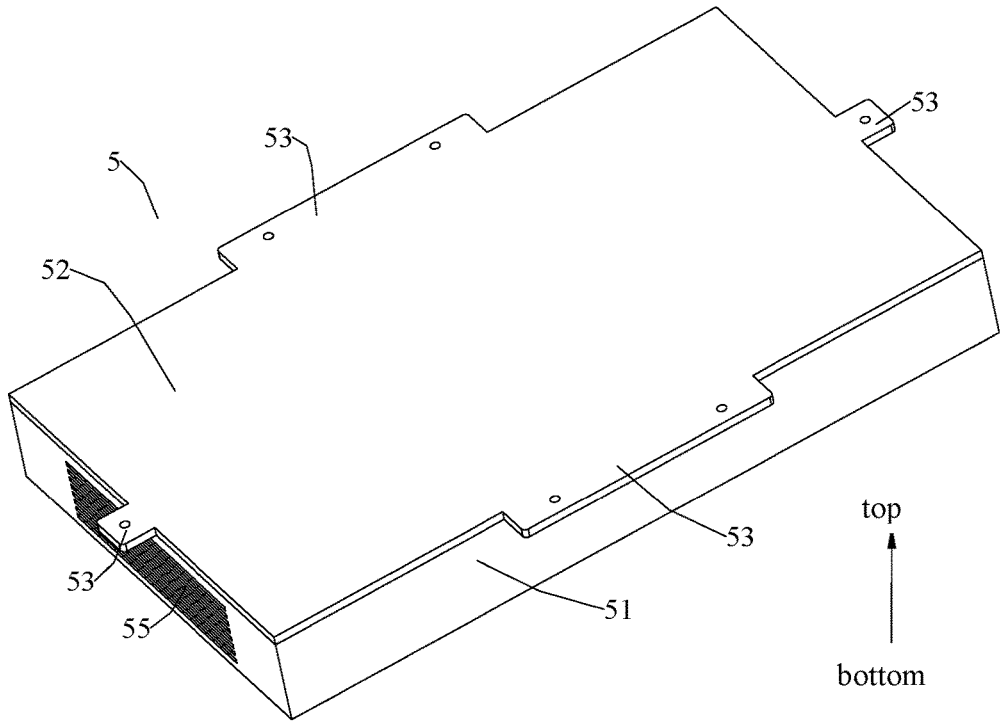

As shown in FIGS. 2 and 3, the air supply port 54 is provided at the bottom wall of the box body 51, and the air return port 55 is provided at the side wall of the box body 51. The first heat exchanger 31 is an air-cooled heat exchanger which is supported on the bottom wall of the box body 51 and located directly above the air supply port 54. In other words, the projection of the first heat exchanger 31 on the bottom wall of the box body 51 and the installation position of the air supply port 54 on the bottom wall of the box body 51 have an overlap area. The first heat exchanger 31 is spaced apart from the air return port 55. The first heat exchanger 31 may use special fins for kitchen air conditioners. The fins have a wide interval and a smooth surface which is hard to accumulate oil. This can cope with the fume environment of the kitchen to a certain extent. In addition, combined with oil-resistant and easy-to-clean high-efficiency filters, the impact of oil fume on air conditioners can be reduced.

As shown in FIG. 2, in a specific embodiment of the present disclosure, the first heat exchanger 31 and the phase-change thermal-storage heat exchanger 1 are spaced apart from each other along a length direction of the box 5 and located at two ends of the box 5. The reversing unit 4 and the compressor 2 are arranged on one side along a width direction of the box 5, and are located between the first heat exchanger 31 and the phase-change thermal-storage heat exchanger 1. The throttling device is arranged on the other side in the width direction of the box 5. The structural dimensions of the reversing unit 4 and the throttling device are small, which can meet space requirements. The compressor 2 adopts a miniature compressor 2 with a small structural size, so it can also meet space requirements.

The first heat exchanger 31 and the phase-change thermal-storage heat exchanger 1 are both of a flat shape so as to be mounted in the box 5. The first heat exchanger 31 is an air-cooled heat exchanger. Through the heat exchange between the refrigerant and the air, cooling or heating effects can be achieved. Due to the limitation of ceiling height, the first heat exchanger 31 also mainly adopts a flat form. The overall shape in the horizontal direction can be selected in various ways, such as a square, a rectangle or the like. Because the space in the horizontal direction is generally large, a single-row heat exchanger with a large horizontal dimension can be provided. Specific types of the heat exchanger can be copper tube fin heat exchangers, micro-channel heat exchangers etc.

As shown in FIGS. 1 and 2, the ceiling-mounted air conditioner according to some preferred embodiments of the present disclosure further includes a reversing unit 4 which includes a first port 41, a second port 42, a third port 43 and a fourth port 44. The compressor 2 has an inlet 21 and an outlet 22. The outlet 22 is communicated with the first port 41 and the inlet 21 is communicated with the third port 43. One end of the first heat exchanger 31 is communicated with the second port 42. One end of the phase-change thermal-storage heat exchanger 1 and the other end of the first heat exchanger 31 are communicated by a throttling device. The other end of the phase-change thermal-storage heat exchanger 1 is communicated with the fourth port 44.

The first port 41 may be communicated with one of the second port 42 and the fourth port 44, and the third port 43 may be communicated with the other of the second port 42 and the fourth port 44. For example, when the first port 41 is communicated with the second port 42, the third port 43 is communicated with the fourth port 44. When the first port 41 is communicated with the fourth port 44, the third port 43 is communicated with the second port 42. Thereby, the ceiling-mounted air conditioner can be switched between a cooling mode and a heating mode. Alternatively, the reversing unit 4 may be a four-way reversing valve, but is not limited thereto.

Specifically, when the ceiling-mounted air conditioner is operating in the cooling mode, the first port 41 of the reversing unit 4 is communicated with the fourth port 44, and the third port 43 is communicated with the second port 42. It circulates in a way that the refrigerant flows through the outlet 22 of the compressor 2, the first port 41, the fourth port 44 of the reversing unit 4, the phase-change thermal-storage heat exchanger 1, the throttling device, the first heat exchanger 31, the second port 42 and the third port 43 of the reversing unit 4, and refrigerant finally returns from the inlet 21 of the compressor 2 into the compressor 2. At this time, the first heat exchanger 31 is an evaporator, and the phase-change thermal-storage heat exchanger 1 is a condenser. When the refrigerant flows through the phase-change thermal-storage heat exchanger 1, it exchanges heat with the phase change medium. The heat released by the refrigerant is absorbed and stored by the phase change medium, and the state of the phase change medium changes, such as from a solid state to a liquid state. When the refrigerant flows through the first heat exchanger 31, it performs heat exchange with the air and absorbs the heat in the air to achieve the purpose of cooling.

When the ceiling-mounted air conditioner is operating in the heating mode, the direction of refrigerant flow can be switched by the reversing unit 4. The first port 41 of the reversing unit 4 is communicated with the second port 42, and the third port 43 is communicated with the fourth port 44. In this process, it circulates in a way that the refrigerant flows through the outlet 22 of the compressor 2, the first port 41, the second port 42, the first heat exchanger 31, the throttling device, the phase-change thermal-storage heat exchanger 1, the fourth port 44 and the third port 43 of the reversing unit 4, and the refrigerant finally returns from the inlet 21 of the compressor 2 into the compressor 2. At this time, the phase-change thermal-storage heat exchanger 1 is an evaporator, and the first heat exchanger 31 is a condenser. When the refrigerant flows through the phase-change thermal-storage heat exchanger 1, the refrigerant and the phase change medium exchange heat. The refrigerant absorbs the heat stored in the phase change medium, and the state of the phase change medium changes, such as from a liquid state to a solid state. When the refrigerant flows through the first heat exchanger 31, it performs heat exchange with the air to release heat to the air, thereby achieving the purpose of heating.

During the cooling operation of the air conditioner, the phase change medium absorbs and stores the condensation heat, and its state changes from solid to liquid. When the phase change medium is completely changed to a liquid state, its heat storage capacity reaches the upper limit. At this time, the air conditioner cannot continue to perform cooling. The air conditioner needs to start a first regeneration process to restore the heat storage capacity of the phase change medium. Of course, when the phase change medium is not completely converted to a liquid state, if the cooking is completed, the first regeneration process may also be started to maximize the heat storage capacity of the phase-change thermal-storage heat exchanger 1. This process is similar to battery charging, which can change the phase change medium from a liquid state to a solid state in a short time, and restore the heat storage capacity so that the air conditioner can continue to perform cooling. The first regeneration process of the phase change medium is realized by stopping the refrigeration cycle of the air conditioner and then starting the heating cycle of the air conditioner to make the refrigerant absorb the heat stored in the phase change medium and restore the heat storage capacity. The regeneration process can be started when the air conditioner does not need refrigeration, for example, it can be started at night. Because hot air will be sent to the kitchen during the first regeneration process, doors and windows connecting the kitchen and the indoor room need to be closed to prevent heat from entering other spaces in the room. Windows connecting the kitchen and the outside can be opened for air circulation, and the outdoor air can also remove heat from the kitchen.

Similarly, during the heating operation of the air conditioner, the phase change medium changes from a liquid state to a solid state because the refrigerant absorbs heat from the phase change medium. When the phase change medium is completely converted to a solid state, its heat release capacity reaches the upper limit, and the air conditioner cannot continue to perform heating at this time. The air conditioner needs to start a second regeneration process to restore the heat release capacity of the phase change medium. Of course, when the phase change medium is not completely converted to a solid state, if the cooking is completed, the second regeneration process may also be started to maximize the heat release capacity of the phase-change thermal-storage heat exchanger 1. The second regeneration process is opposite to the above-mentioned first regeneration process, which can change the phase change medium from a solid state to a liquid state in a short time, and restore the heat release capability so that the air conditioner can continue to perform heating. The implementation method is to stop the heating cycle of the air conditioner and start the refrigeration cycle of the air conditioner. In the process, the phase change medium absorbs and stores the heat of condensation, and changes from a solid state to a liquid state, thereby restoring the heat release capability. This second regeneration process is usually started when the air conditioner does not require to perform heating. Because cold air will be sent to the kitchen during the second regeneration process, the doors and windows connecting the kitchen and the indoor room need to be closed to prevent cold air from entering other spaces in the room. Windows connecting the kitchen and the outside can be opened for air circulation.

Therefore, by providing the reversing unit 4, the mode of the ceiling-mounted air conditioner can be easily switched, so that the cooling capacity or heating capacity can be provided by the ceiling-mounted air conditioner as required. At the same time, the regeneration function can be realized by switching the mode of the ceiling-mounted air conditioner, so that the phase change medium can restore its capacity to store heat and release heat.

According to some embodiments of the present disclosure, referring to FIGS. 1 and 2, the throttling device includes a first throttling element 63 and a third throttling element 69. The ceiling-mounted air conditioner further includes a first throttle branch and a third throttle branch. A first check valve 61 is provided in the first throttle branch, and a third check valve 67 is provided in the third throttle branch.

Specifically, one end (for example, a left end in FIG. 1) of the first throttle branch is communicated with the first heat exchanger 31, and the other end (for example, a right end in FIG. 1) of the first throttle branch is communicated with the phase-change thermal-storage heat exchanger 1. The first throttling element 63 is communicated in series with the first check valve 61 in the first throttle branch. The first check valve 61 is located at one end of the first throttling element 63 adjacent to the phase-change thermal-storage heat exchanger 1 so that the refrigerant in the phase-change thermal-storage heat exchanger 1 flows to the first throttling element 63. A first drying filter 62 may be further provided between the first throttling element 63 and the first check valve 61, and the first drying filter 62 is configured to absorb moisture in the refrigerant.

The third throttle branch and the first throttle branch are connected in parallel between the first heat exchanger 31 and the phase-change thermal-storage heat exchanger 1. The third throttling element 69 and the third check valve 67 are communicated in series in the third throttle branch. The third check valve 67 is located at an end of the third throttling element 69 adjacent to the first heat exchanger 31 so that the refrigerant in the first heat exchanger 31 flows to the third throttling element 69. A third drying filter 68 may be further provided between the third throttling element 69 and the third check valve 67, and the third drying filter 68 is used to absorb moisture in the refrigerant.

Therefore, the refrigerant in the cooling process can be throttled and depressurized by the first throttling element 63, and the refrigerant in the heating process can be throttled and depressurized by the third throttling element 69. As a result, different throttling elements can be used to throttle and depressurize the refrigerant in the cooling process and the heating process, respectively. The effect of throttling and depressurizing is guaranteed, and the cooling performance and heating performance of the air conditioner are improved.

Alternatively, the first throttling element 63 and the third throttling element 69 may be capillaries, thermal expansion valves, electronic expansion valves, or the like.

The air conditioner in an embodiment of the present disclosure may be an embedded air conditioner.

Referring to FIGS. 1, 7 to 10, the embedded air conditioner according to the embodiment of the present disclosure is described below. The embedded air conditioner can be used in an indoor environment such as a kitchen. The embedded air conditioner is integrally embedded in a cabinet.

Referring to FIGS. 1, 7 to 10, the embedded air conditioner according to the embodiment of the present disclosure includes a compressor 2, a first heat exchanger 31, a phase-change thermal-storage heat exchanger 1, a throttling device and a box 5.

The box 5 has an air supply port 54 and an air return port 55. The box 5 is adapted for being embedded in a cabinet, which can more effectively use the kitchen space and be beautiful. When decorating, you can match the embedded air conditioner and the cabinet at once, which will make the entire kitchen have a stronger integration.

The compressor 2, the first heat exchanger 31, the phase-change thermal-storage heat exchanger 1 and the throttling device are all disposed in the box 5, and refrigeration system pipes are laid in the box 5 as well. In other words, the embedded air conditioner has an integrated structure of which the overall structure is more compact. There is no need to separately install an indoor unit and an outdoor unit, which facilitates the installation.

The compressor 2, the phase-change thermal-storage heat exchanger 1, the throttling device and the first heat exchanger 31 are communicated to form a refrigerant circuit. The compressor 2, the phase-change thermal-storage heat exchanger 1, the throttling device and the first heat exchanger 31 are capable of being communicated with each other through copper pipes.

The first heat exchanger 31 is provided between the air supply port 54 and the air return port 55. During work, air enters and leaves the box 5 through the air return port 55 and the air supply port 54 respectively, and exchanges heat with the first heat exchanger 31 to achieve indoor air temperature adjustment. For example, the first heat exchanger 31 may be an air-cooled heat exchanger. A fan of the air-cooled heat exchanger draws outside air into the box 5, exchanges heat with the refrigerant in the first heat exchanger 31, and blows it into an indoor room from the air supply port 54.

The compressor 2 has an outlet 22 and an inlet 21. The heat-exchanged refrigerant can enter the compressor 2 from the inlet 21, and the refrigerant can be discharged from the outlet 22 after being compressed by the compressor 2. It should be noted that the structure and working principle of the compressor 2 are well known to those skilled in the art, therefore it will not be described in detail here.

Referring to FIG. 1, the refrigerant circuit of the ceiling-mounted air conditioner is described below. Specifically, one of a first end (for example, a left end shown in FIG. 1) of the first heat exchanger 31 and a first end (for example, an upper end shown in FIG. 1) of the phase-change thermal-storage heat exchanger 1 may be communicated with the outlet 22, and the other of the first end of the first heat exchanger 31 and the first end of the phase-change thermal-storage heat exchanger 1 is communicated with the inlet 21. The throttling device may be provided at a second end (for example, a right end shown in FIG. 1) of the first heat exchanger 31 and a second end (for example, a lower end shown in FIG. 1) of the phase-change thermal-storage heat exchanger 1. That is, the second end of the first heat exchanger 31 and the second end of the phase-change thermal-storage heat exchanger 1 may be communicated with two ends of the throttling device, respectively.

When the refrigerant flows through the first heat exchanger 31, it performs heat exchange with air to achieve the purpose of cooling or heating. After the refrigerant enters the phase-change thermal-storage heat exchanger 1, it can exchange heat with the phase change medium in the phase-change thermal-storage heat exchanger 1. After the phase change medium absorbs or releases heat, it realizes the storage and release of heat through the change of its phase state. In the meanwhile, the refrigerant does not need to exchange heat with the environment after heat exchange in the phase-change thermal-storage heat exchanger 1, which makes the ceiling-mounted air conditioner unnecessarily to release heat to the environment during cooling, and unnecessarily to absorb heat from the environment during heating. As a result, the integrated structure of the ceiling-mounted air conditioner can be realized, which breaks the tradition of the split structure of the traditional air conditioner.

For example, when the inlet 21 is communicated with the first end of the first heat exchanger 31 and the outlet 22 is communicated with the first end of the phase-change thermal-storage heat exchanger 1, the ceiling-mounted air conditioner can provide users with cooling capacity. The high-temperature and high-pressure gaseous refrigerant discharged from the outlet 22 can firstly flow to the phase-change thermal-storage heat exchanger 1. The refrigerant exchanges heat with the phase change medium in the phase-change thermal-storage heat exchanger 1 to form a liquid refrigerant and then flows to the throttling device from the phase-change thermal-storage heat exchanger 1. After the throttling device throttles and reduces pressure, the refrigerant forms a low-temperature and low-pressure refrigerant and flows to the first heat exchanger 31. The refrigerant exchanges heat with the air in the first heat exchanger 31 to provide the user with cooling capacity and form a gaseous refrigerant, and then the refrigerant returns to the compressor 2 from the inlet 21.

Accordingly, when the inlet 21 is communicated with the first end of the phase-change thermal-storage heat exchanger 1 and the outlet 22 is communicated with the first end of the first heat exchanger 31, the embedded air conditioner can provide users with heating capacity.

The embedded air conditioner according to the embodiment of the present disclosure does not need to release heat to the environment during cooling, and does not need to absorb heat from the environment during heating. Therefore, it is capable of realizing an integrated design and being installed on the roof without taking up extra space in the kitchen and with good decoration.

In some preferred embodiments of the present disclosure, as shown in FIGS. 7 to 10, the box 5 may be of a cuboid shape. Both the air supply port 54 and the air return port 55 are provided at a front wall of the box 5, and other walls of the box 5 are adapted for being embedded in a cabinet. That is to say, except that a side of the box 5 with the air openings can be seen, other five sides are embedded in the cabinet, which does not take up extra space in the kitchen, does not affect the overall aesthetics of the kitchen, and does not cause inconvenience to a cooking people.

It should be noted that the front wall is the side of the box 5 facing the indoor space. The rear wall opposite to the front wall and the four side walls of the cabinet adjacent to the front wall are embedded in the cabinet. The box 5 does not interfere with the daily life in the kitchen.

Front is a side of the box facing the indoor space. Rear is a direction away from the front. Left is a direction of a left hand of a cooking people when facing the box. Right is a direction of a right hand of the cooking people when facing the box. Top is a direction of the box facing away from the ground. Bottom is a direction of the box close to the ground.

Preferably, as shown in FIGS. 7 to 10, the air return port 55 is provided below the front wall to reduce absorption of oil fume. The shape of the air supply port 54 and the air return port 55 may be variously selected. The shape of the air supply port 54 may be rectangular or circular etc. The shape of the air return port 55 may be rectangular or circular etc.

Figure 8:
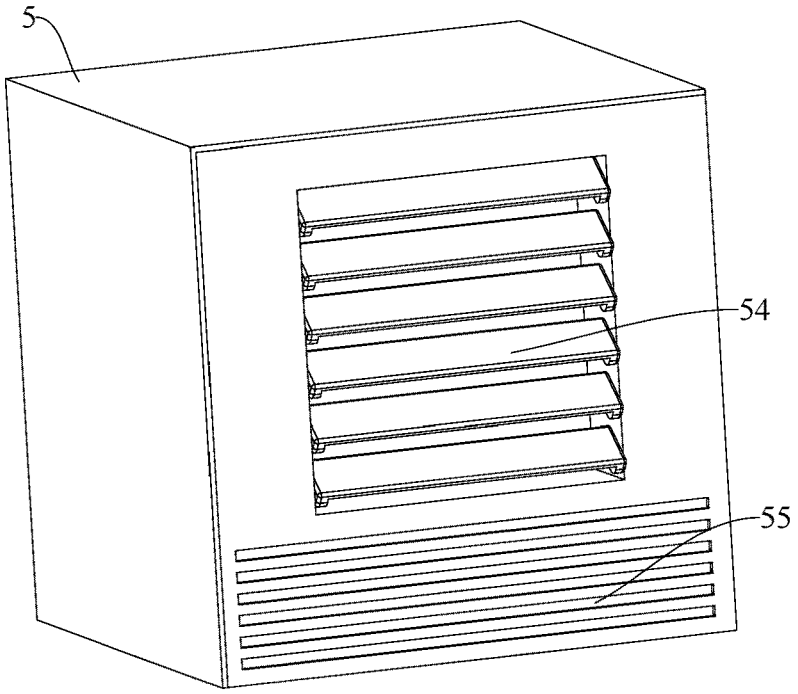

As shown in FIG. 8, the air supply port 54 is provided with louvers to control the air supply direction. For the installation orientation of the embedded air conditioner, it is better to make the supply opening 54 facing a side or back of a human body, and the distance should not be too far, so as to ensure that heat feeling of the human body can be eliminated when cooking.

At least one of the air supply port 54 and the air return port 55 is detachable, which is convenient for cleaning.

The air supply port 54 is provided above the air return port 55. The first heat exchanger 31 is an air-cooled heat exchanger. The first heat exchanger 31 is connected to the front wall of the box 5, and the first heat exchanger 31 is located directly in a rear side of the supply opening 54. In other words, the projection of the first heat exchanger 31 on the front wall of the box 5 and the installation position of the air supply port 54 on the front wall of the box 5 have an overlapping area. The projections of the first heat exchanger 31 and the air return port 55 on the front wall of the box 5 do not have an overlap area. Thereby, the movement of the air flow is smooth and the heat exchange efficiency is high.

Figure 9:
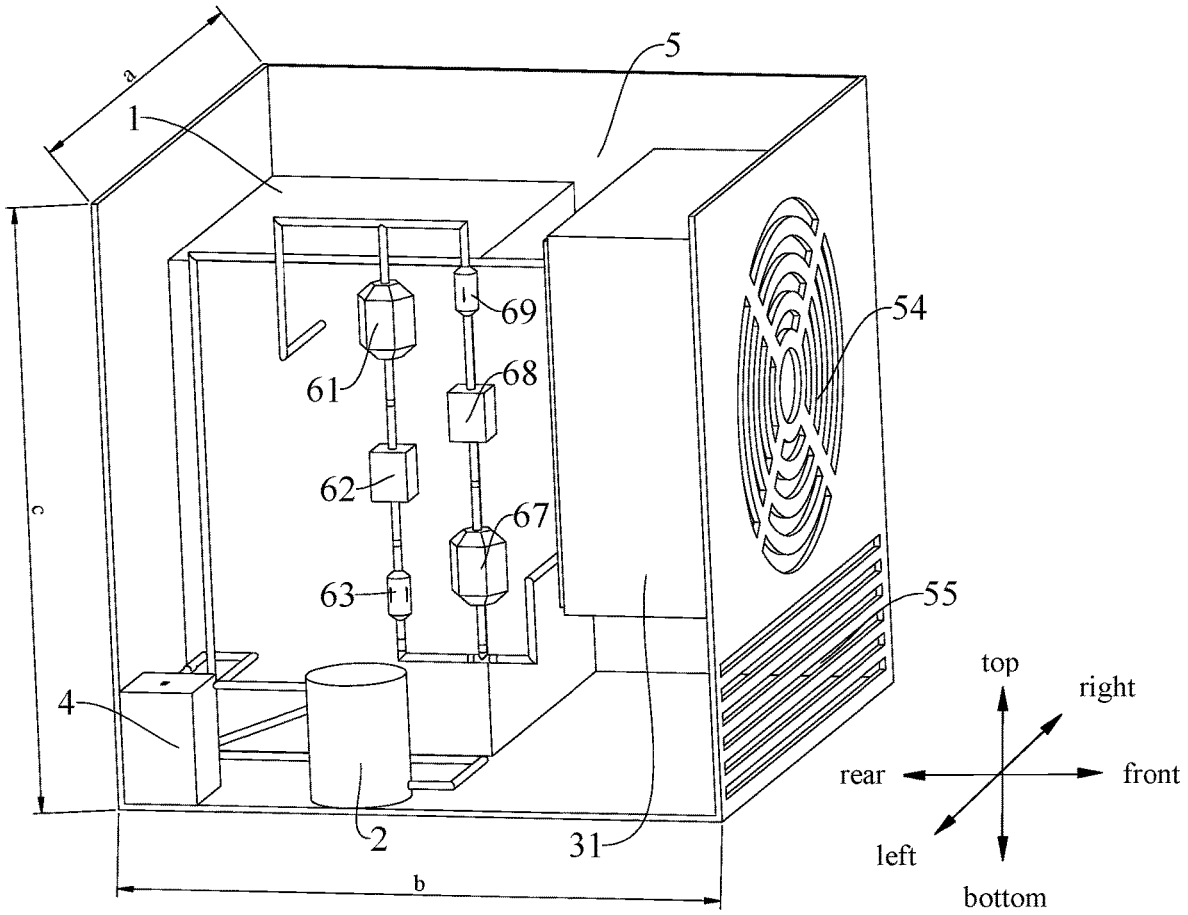

In some alternative embodiments, as shown in FIG. 9, the box 5 is of a cuboid shape, and the phase-change thermal-storage heat exchanger 1 and the compressor 2 are disposed in a rear side of the box 5 and spaced apart from each other in the left-to-right direction. The first heat exchanger 31 is provided in a front side of the box 5. Correspondingly, a length, a width and a height of the box 5 are a, b and c, respectively and the following conditions are satisfied: $0.5a<b\leq a$, $0.5b\leq c\leq 2b$, $0.3a\leq c\leq 2a$.

Figure 10:
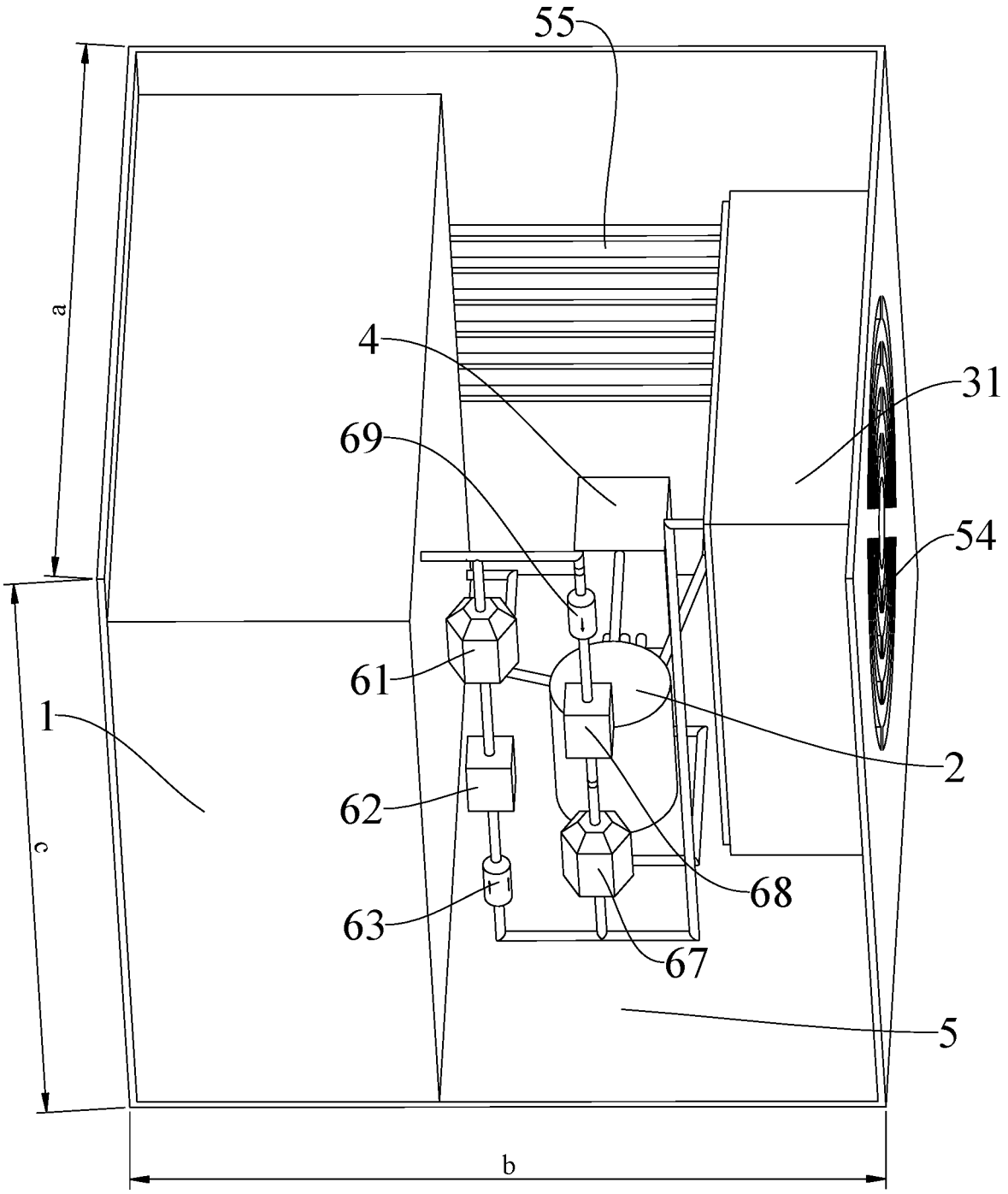

In other optional embodiments, as shown in FIG. 10, the box 5 is of a cuboid shape. The phase-change thermal-storage heat exchanger 1 is provided in a rear side of the box 5. The first heat exchanger 31 is provided in a front side of the box 5. The compressor 2 and pipelines of the refrigerant circuit are provided between the phase-change thermal-storage heat exchanger 1 and the first heat exchanger 31. Correspondingly, a length, a width and a height of the box 5 are a, b and c, respectively, and the following conditions are satisfied: $0.5b<a\leq b$, $0.5a\leq c\leq 2a$, $0.3b\leq c\leq 2b$.

In a specific embodiment, the box 5 may be designed of a cube shape, or a cuboid shape having substantially equal length, width and height. It can be understood that the shape of the box 5 is designed according to the specific size of the cabinet, and the arrangement manner of the components in the box 5 is then designed.

The first heat exchanger 31 may use special fins for kitchen air conditioners. The fins have a wide interval and a smooth surface which is hard to accumulate oil. This can cope with the fume environment of the kitchen to a certain extent. In addition, combined with oil-resistant and easy-to-clean high-efficiency filters, the impact of oil fume on air conditioners can be reduced.

As shown in FIG. 1 and FIG. 10, the embedded air conditioner according to some preferred embodiments of the present disclosure further includes a reversing unit 4. For the specific structure of the reversing unit 4 and the specific structure of the throttling device, reference may be made to the description of the ceiling-mounted air conditioner. The operating principle of the embedded air conditioner can also refer to the description of the ceiling-mounted air conditioner.

Referring to FIGS. 1 and 11 to 14, a wall-mounted air conditioner according to an embodiment of the present disclosure is described below. The wall-mounted air conditioner can be used in an indoor environment such as a kitchen. The wall-mounted air conditioner is suspended on a side wall in the kitchen. The wall-mounted air conditioner can also be designed together during the decoration, so that the entire kitchen has a stronger integrity, saves installation space and does not affect other indoor items.

As shown in FIGS. 1 and 11 to 14, the wall-mounted air conditioner according to an embodiment of the present disclosure includes a compressor 2, a first heat exchanger 31, a phase-change thermal-storage heat exchanger 1, a throttling device and a box 5.

The box 5 has an air supply port 54 and an air return port 55. The box 5 is adapted for being mounted to a wall, which can more effectively use the kitchen space and be beautiful.

The compressor 2, the first heat exchanger 31, the phase-change thermal-storage heat exchanger 1 and the throttling device are all disposed in the box 5, and refrigeration system pipes are laid in the box 5 as well. In other words, the wall-mounted air conditioner has an integrated structure of which the overall structure is more compact. There is no need to separately install an indoor unit and an outdoor unit, which facilitates the installation.

The compressor 2, the phase-change thermal-storage heat exchanger 1, the throttling device and the first heat exchanger 31 are communicated to form a refrigerant circuit. The compressor 2, the phase-change thermal-storage heat exchanger 1, the throttling device and the first heat exchanger 31 are capable of being communicated with each other through copper pipes.

The first heat exchanger 31 is provided between the air supply port 54 and the air return port 55. During work, air enters and leaves the box 5 through the air return port 55 and the air supply port 54 respectively, and exchanges heat with the first heat exchanger 31 to achieve indoor air temperature adjustment. For example, the first heat exchanger 31 may be an air-cooled heat exchanger. A fan of the air-cooled heat exchanger draws outside air into the box 5, exchanges heat with the refrigerant in the first heat exchanger 31, and blows it into an indoor room from the air supply port 54.

The compressor 2 has an outlet 22 and an inlet 21. The heat-exchanged refrigerant can enter the compressor 2 from the inlet 21, and the refrigerant can be discharged from the outlet 22 after being compressed by the compressor 2. It should be noted that the structure and working principle of the compressor 2 are well known to those skilled in the art, therefore it will not be described in detail here.

Referring to FIG. 1, the refrigerant circuit of the wall-mounted air conditioner is described below. Specifically, one of a first end (for example, a left end shown in FIG. 1) of the first heat exchanger 31 and a first end (for example, an upper end shown in FIG. 1) of the phase-change thermal-storage heat exchanger 1 may be communicated with the outlet 22, and the other of the first end of the first heat exchanger 31 and the first end of the phase-change thermal-storage heat exchanger 1 is communicated with the inlet 21. The throttling device may be provided at a second end (for example, a right end shown in FIG. 1) of the first heat exchanger 31 and a second end (for example, a lower end shown in FIG. 1) of the phase-change thermal-storage heat exchanger 1. That is, the second end of the first heat exchanger 31 and the second end of the phase-change thermal-storage heat exchanger 1 may be communicated with two ends of the throttling device, respectively.

When the refrigerant flows through the first heat exchanger 31, it performs heat exchange with air to achieve the purpose of cooling or heating. After the refrigerant enters the phase-change thermal-storage heat exchanger 1, it can exchange heat with the phase change medium in the phase-change thermal-storage heat exchanger 1. After the phase change medium absorbs or releases heat, it realizes the storage and release of heat through the change of its phase state. In the meanwhile, the refrigerant does not need to exchange heat with the environment after heat exchange in the phase-change thermal-storage heat exchanger 1, which makes the wall-mounted air conditioner unnecessarily to release heat to the environment during cooling, and unnecessarily to absorb heat from the environment during heating. As a result, the integrated structure of the wall-mounted air conditioner can be realized, which breaks the tradition of the split structure of the traditional air conditioner.

For example, when the inlet 21 is communicated with the first end of the first heat exchanger 31 and the outlet 22 is communicated with the first end of the phase-change thermal-storage heat exchanger 1, the wall-mounted air conditioner can provide users with cooling capacity. The high-temperature and high-pressure gaseous refrigerant discharged from the outlet 22 can firstly flow to the phase-change thermal-storage heat exchanger 1. The refrigerant exchanges heat with the phase change medium in the phase-change thermal-storage heat exchanger 1 to form a liquid refrigerant and then flows to the throttling device from the phase-change thermal-storage heat exchanger 1. After the throttling device throttles and reduces pressure, the refrigerant forms a low-temperature and low-pressure refrigerant and flows to the first heat exchanger 31. The refrigerant exchanges heat with the air in the first heat exchanger 31 to provide the user with cooling capacity and form a gaseous refrigerant, and then the refrigerant returns to the compressor 2 from the inlet 21.

Accordingly, when the inlet 21 is communicated with the first end of the phase-change thermal-storage heat exchanger 1 and the outlet 22 is communicated with the first end of the first heat exchanger 31, the wall-mounted air conditioner can provide users with heating capacity.

The wall-mounted air conditioner according to the embodiment of the present disclosure does not need to release heat to the environment during cooling, and does not need to absorb heat from the environment during heating. Therefore, it is capable of realizing an integrated design and being mounted on a wall without taking up extra space in the kitchen and with good decoration.

In some preferred embodiments of the present disclosure, as shown in FIGS. 11 to 14, the box 5 may be of a cuboid shape, and the air supply port 54 and the air return port 55 are provided at the front wall of the box 5 and the rear wall of the box 5 is closed to the wall. For the installation orientation of the wall-mounted air conditioner, it is better to make the supply opening 54 facing a side or back of a human body, and the distance should not be too far, and the height can be adjusted appropriately to ensure that heat feeling of the human body can be eliminated when cooking. Of course, the air supply port and air return port can also be provided at other walls of the box 5, such as the left side wall and right side wall, as long as the air supply and air return conditions are satisfied, which will not be repeated here.

It should be noted that the front wall is a wall of the box 5 facing a people cooking in the kitchen, the rear wall of the box is opposite to the front wall, the rear wall of the box is adapted for being mounted on a wall of the kitchen, and the side walls of the box 5 include a left wall and a right wall.

Front is a side of the box facing the indoor space. Rear is a direction away from the front. Left is a direction of a left hand of a cooking people when facing the box. Right is a direction of a right hand of the cooking people when facing the box. Top is a direction of the box facing away from the ground. Bottom is a direction of the box close to the ground.

Of course, the air supply port 54 and the air return port 55 may both be provided at the front wall of the box 5, in which the air return port 55 may be provided at the bottom of the front wall to reduce absorption of oil fume. The shape of the air supply port 54 and the air return port 55 may be variously selected. The shape of the air supply port 54 may be rectangular or circular etc. The shape of the air return port 55 may be rectangular or circular etc. Of course, the air supply port and air return port can also be provided at other walls of the box 5, such as the left side wall and right side wall, as long as the air supply and air return conditions are satisfied, which will not be repeated here.

Figure 11:
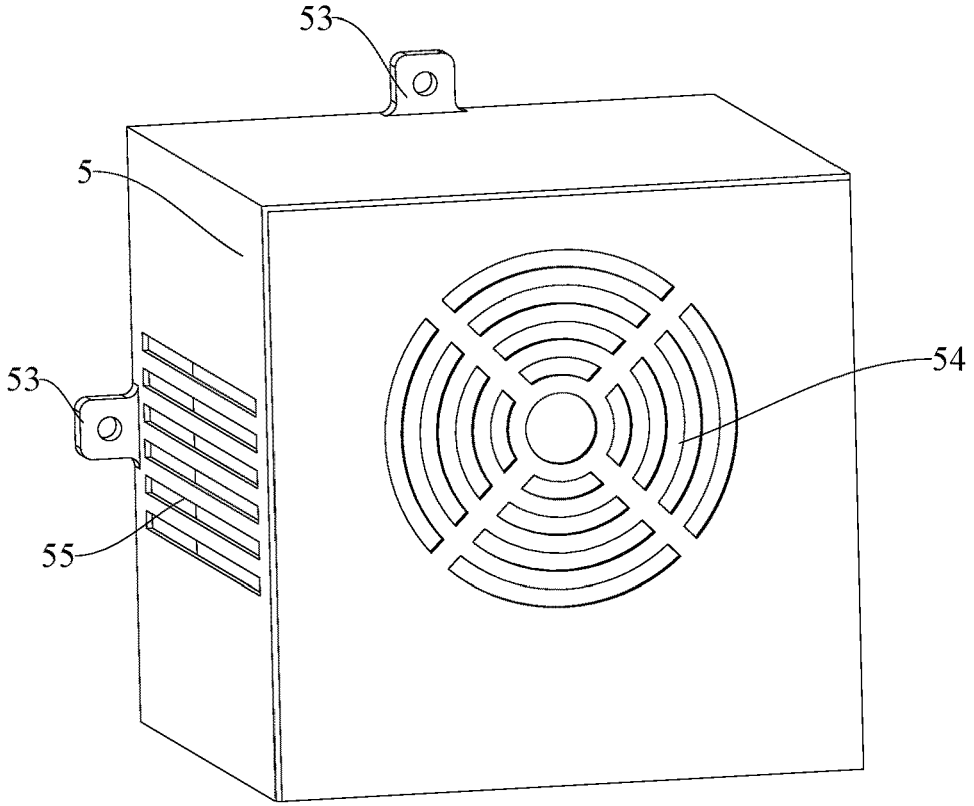
FIGS. 11 to 14 are schematic structural diagrams of a wall-mounted air conditioner according to an embodiment of the present disclosure.

As shown in FIG. 11, the air supply port 54 is provided with louvers to control the air supply direction. For the installation orientation of the wall-mounted air conditioner, it is better to make the supply opening 54 facing a side or back of a human body, and the distance should not be too far, so as to ensure that heat feeling of the human body can be eliminated when cooking.

At least one of the air supply port 54 and the air return port 55 is detachable, which is convenient for cleaning.

The first heat exchanger 31 is an air-cooled heat exchanger. The first heat exchanger 31 is connected to the front wall of the box 5, and the first heat exchanger 31 is located directly in a rear side of the supply opening 54. In other words, the projection of the first heat exchanger 31 on the front wall of the box 5 and the installation position of the air supply port 54 on the front wall of the box 5 have an overlapping area. Thereby, the movement of the air flow is smooth and the heat exchange efficiency is high.

Figure 12:
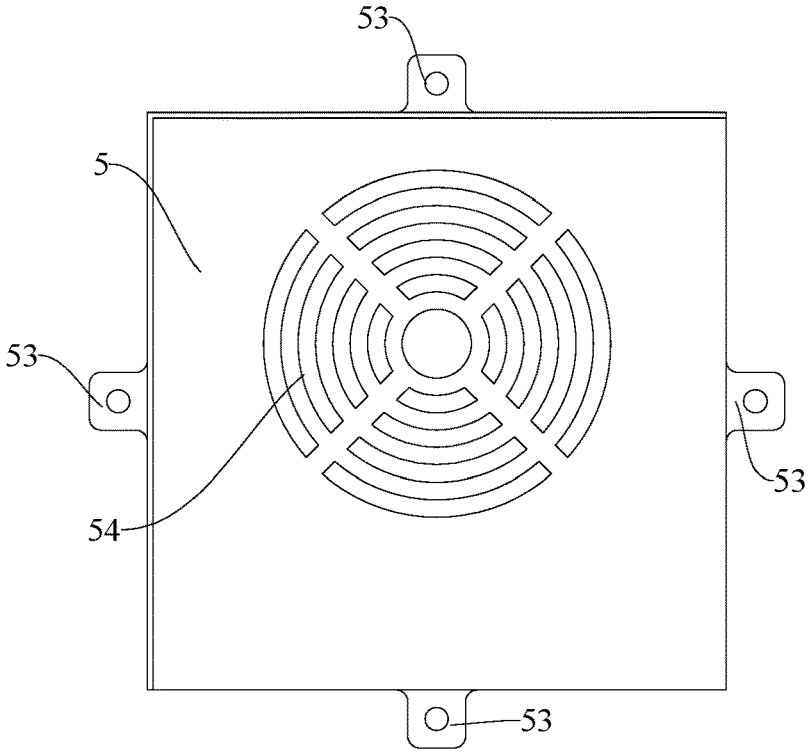

In some optional embodiments, as shown in FIGS. 11 and 12, the box 5 is of a cuboid shape. The box 5 is provided with a plurality of lugs 53, and the lugs 53 are provided with mounting holes. The lugs 53 are used to suspend the box 5 on the wall. For example, four edges of the rear wall of the box 5 may be provided with one lug 53, or each end of the top wall, the left wall, the right wall and the bottom wall of the box 5, which is near the rear wall, is provided with one lug 53.

In some alternative embodiments, the box 5 is of a cuboid shape, and the phase-change thermal-storage heat exchanger 1 and the compressor 2 are disposed in a rear side of the box 5 and spaced apart from each other in the left-to-right direction. The first heat exchanger 31 is provided in a front side of the box 5. Correspondingly, a length, a width and a height of the box 5 are a, b and c, respectively and the following conditions are satisfied: $0.5a<b\leq a$, $0.5b\leq c\leq 2b$, $0.3a\leq c\leq 2a$.

Figure 13:
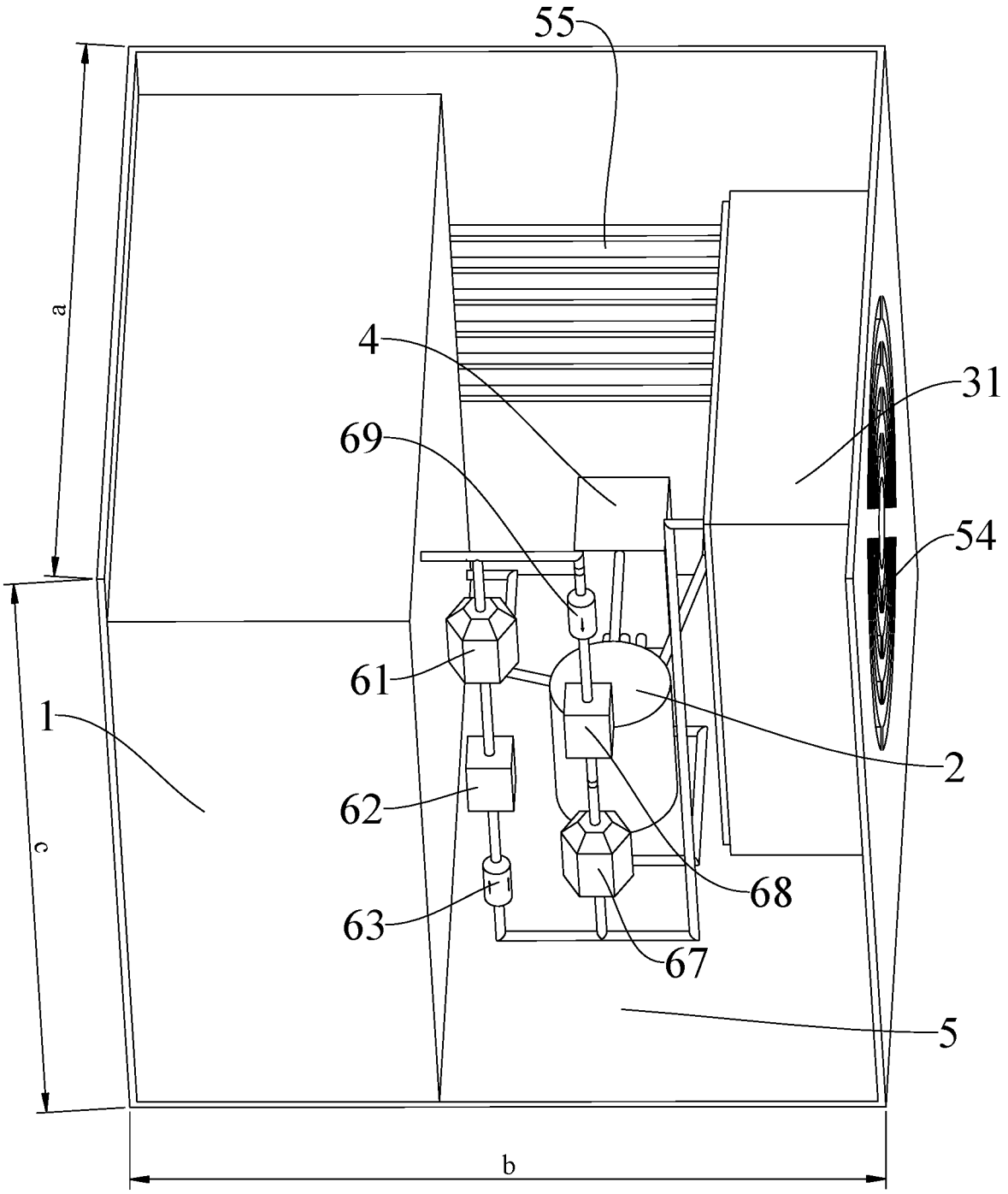
Figure 14:
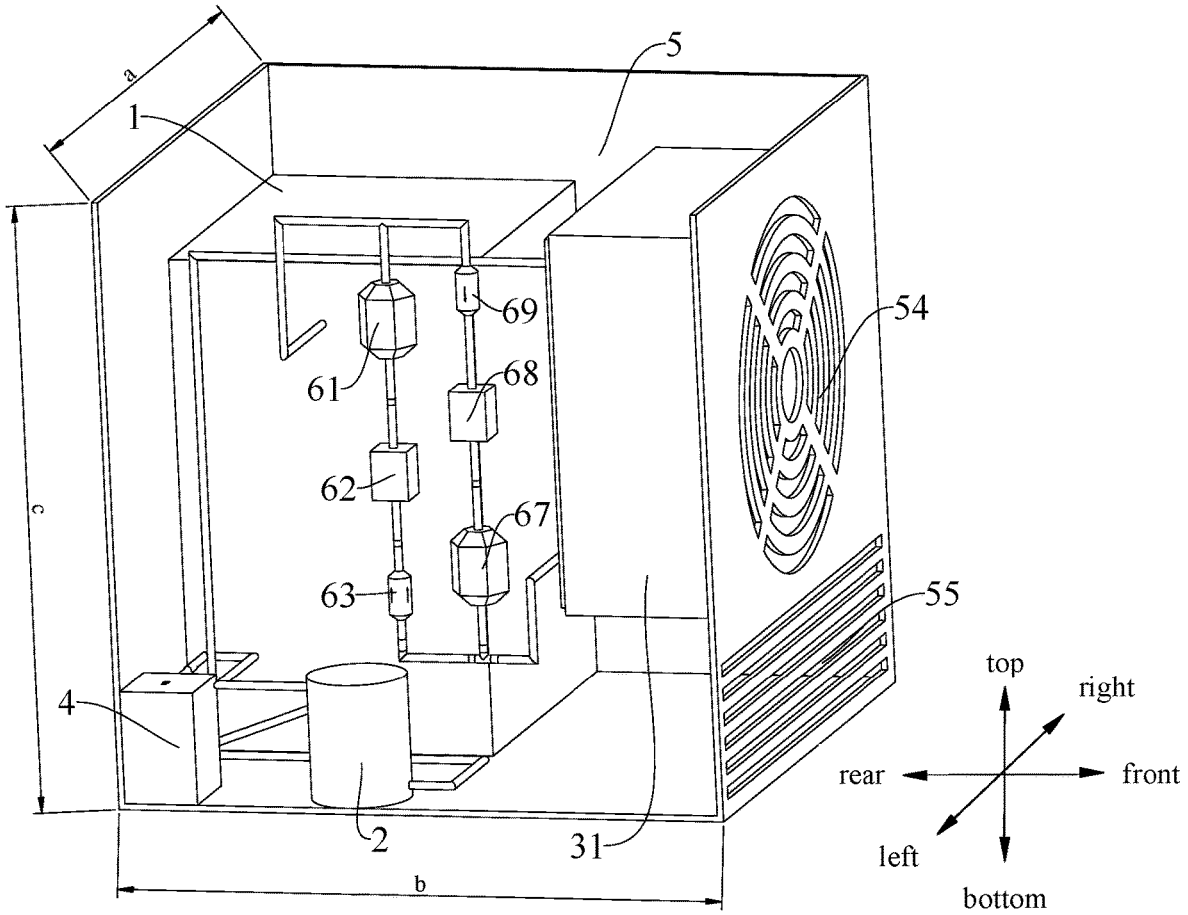

In other optional embodiments, as shown in FIG. 13, the box 5 is of a cuboid shape. The phase-change thermal-storage heat exchanger 1 is provided in a rear side of the box 5. The first heat exchanger 31 is provided in a front side of the box 5. The compressor 2 and pipelines of the refrigerant circuit are provided between the phase-change thermal-storage heat exchanger 1 and the first heat exchanger 31. Correspondingly, a length, a width and a height of the box 5 are a, b and c, respectively, and the following conditions are satisfied: $0.5b<a\leq b$, $0.5a\leq c\leq 2a$, $0.3b\leq c\leq 2b$. In a specific embodiment, the box 5 may be designed of a cube shape, or a cuboid shape having substantially equal length, width and height.

The first heat exchanger 31 may use special fins for kitchen air conditioners. The fins have a wide interval and a smooth surface which is hard to accumulate oil. This can cope with the fume environment of the kitchen to a certain extent. In addition, combined with oil-resistant and easy-to-clean high-efficiency filters, the impact of oil fume on air conditioners can be reduced.

As shown in FIG. 1, the wall-mounted air conditioner according to some preferred embodiments of the present disclosure further includes a reversing unit 4. For the specific structure of the reversing unit 4 and the specific structure of the throttling device, reference may be made to the description of the ceiling-mounted air conditioner. The operating principle of the wall-mounted air conditioner can also refer to the description of the ceiling-mounted air conditioner.

Referring to FIGS. 1, 15 to 18, a desktop air conditioner according to an embodiment of the present disclosure is described below. The desktop air conditioner does not need to be mounted in a fixed place, but can be placed anywhere, which is also known as a portable air conditioner.

The desktop air conditioner can be placed in the kitchen to avoid sultry during cooking. The desktop air conditioner can be placed in the bedroom to provide a comfortable sleeping environment. Desktop air conditioner can be placed in the living room for easy entertainment. Desktop air conditioner can be placed in the study room to enjoy cooling study time. In addition to fixed residence, the desktop air conditioner is also very adapted for movable environments such as small cruise ships or trucks etc.

The desktop air conditioner is small and does not perform cooling the entire space environment, but the cooling effect in the local range is more significant, and it has the best use range. Generally, in the environment of about one meter, the desktop air conditioner can play a significant role in improving the temperature.

The desktop air conditioner is convenient to place. The body can be equipped with a power plug to realize plug and play, or the body can be battery-powered which is more convenient to use.

As shown in FIGS. 1 and 15 to 18, the desktop air conditioner according to an embodiment of the present disclosure includes a compressor 2, a first heat exchanger 31, a phase-change thermal-storage heat exchanger 1, a throttling device and a box 5.

As shown in FIGS. 1, 15 to 18, the box 5 has an air supply port 54 and an air return port 55. The box 5 has a handle portion 56 which is provided at a top wall or a side wall of the box 5 to increase the portability of the desktop air conditioner.

The compressor 2, the first heat exchanger 31, the phase-change thermal-storage heat exchanger 1 and the throttling device are all disposed in the box 5, and refrigeration system pipes are laid in the box 5 as well. In other words, the desktop air conditioner has an integrated structure of which the overall structure is more compact. There is no need to separately install an indoor unit and an outdoor unit, which facilitates the installation.

The compressor 2, the phase-change thermal-storage heat exchanger 1, the throttling device and the first heat exchanger 31 are communicated to form a refrigerant circuit. The compressor 2, the phase-change thermal-storage heat exchanger 1, the throttling device and the first heat exchanger 31 are capable of being communicated with each other through copper pipes.

The first heat exchanger 31 is provided between the air supply port 54 and the air return port 55. During work, air enters and leaves the box 5 through the air return port 55 and the air supply port 54 respectively, and exchanges heat with the first heat exchanger 31 to achieve indoor air temperature adjustment. For example, the first heat exchanger 31 may be an air-cooled heat exchanger. A fan of the air-cooled heat exchanger draws outside air into the box 5, exchanges heat with the refrigerant in the first heat exchanger 31, and blows it into an indoor room from the air supply port 54.

The compressor 2 has an outlet 22 and an inlet 21. The heat-exchanged refrigerant can enter the compressor 2 from the inlet 21, and the refrigerant can be discharged from the outlet 22 after being compressed by the compressor 2. It should be noted that the structure and working principle of the compressor 2 are well known to those skilled in the art, therefore it will not be described in detail here.

Referring to FIG. 1, the refrigerant circuit of the desktop air conditioner is described below. Specifically, one of a first end (for example, a left end shown in FIG. 1) of the first heat exchanger 31 and a first end (for example, an upper end shown in FIG. 1) of the phase-change thermal-storage heat exchanger 1 may be communicated with the outlet 22, and the other of the first end of the first heat exchanger 31 and the first end of the phase-change thermal-storage heat exchanger 1 is communicated with the inlet 21. The throttling device may be provided at a second end (for example, a right end shown in FIG. 1) of the first heat exchanger 31 and a second end (for example, a lower end shown in FIG. 1) of the phase-change thermal-storage heat exchanger 1. That is, the second end of the first heat exchanger 31 and the second end of the phase-change thermal-storage heat exchanger 1 may be communicated with two ends of the throttling device, respectively.

When the refrigerant flows through the first heat exchanger 31, it performs heat exchange with air to achieve the purpose of cooling or heating. After the refrigerant enters the phase-change thermal-storage heat exchanger 1, it can exchange heat with the phase change medium in the phase-change thermal-storage heat exchanger 1. After the phase change medium absorbs or releases heat, it realizes the storage and release of heat through the change of its phase state. In the meanwhile, the refrigerant does not need to exchange heat with the environment after heat exchange in the phase-change thermal-storage heat exchanger 1, which makes the desktop air conditioner unnecessarily to release heat to the environment during cooling, and unnecessarily to absorb heat from the environment during heating. As a result, the integrated structure of the desktop air conditioner can be realized, which breaks the tradition of the split structure of the traditional air conditioner.

For example, when the inlet 21 is communicated with the first end of the first heat exchanger 31 and the outlet 22 is communicated with the first end of the phase-change thermal-storage heat exchanger 1, the desktop air conditioner can provide users with cooling capacity. The high-temperature and high-pressure gaseous refrigerant discharged from the outlet 22 can firstly flow to the phase-change thermal-storage heat exchanger 1. The refrigerant exchanges heat with the phase change medium in the phase-change thermal-storage heat exchanger 1 to form a liquid refrigerant and then flows to the throttling device from the phase-change thermal-storage heat exchanger 1. After the throttling device throttles and reduces pressure, the refrigerant forms a low-temperature and low-pressure refrigerant and flows to the first heat exchanger 31. The refrigerant exchanges heat with the air in the first heat exchanger 31 to provide the user with cooling capacity and form a gaseous refrigerant, and then the refrigerant returns to the compressor 2 from the inlet 21.

Accordingly, when the inlet 21 is communicated with the first end of the phase-change thermal-storage heat exchanger 1 and the outlet 22 is communicated with the first end of the first heat exchanger 31, the desktop air conditioner can provide users with heating capacity.

The desktop air conditioner according to the embodiment of the present disclosure does not need to release heat to the environment during cooling, and does not need to absorb heat from the environment during heating. Therefore, it is capable of realizing an integrated design without taking up extra space in the kitchen and with good portability.

In some preferred embodiments of the present disclosure, as shown in FIGS. 15 to 18, the box 5 may be of a cuboid shape. The air supply port 54 is provided at the front wall of the box 5, and the air return port 55 is provided at the side wall or the front wall of the box 5. The shape of the air supply port 54 and the air return port 55 may be variously selected. The shape of the air supply port 54 may be rectangular or circular etc. The shape of the air return port 55 may be rectangular or circular etc.

Figure 15:
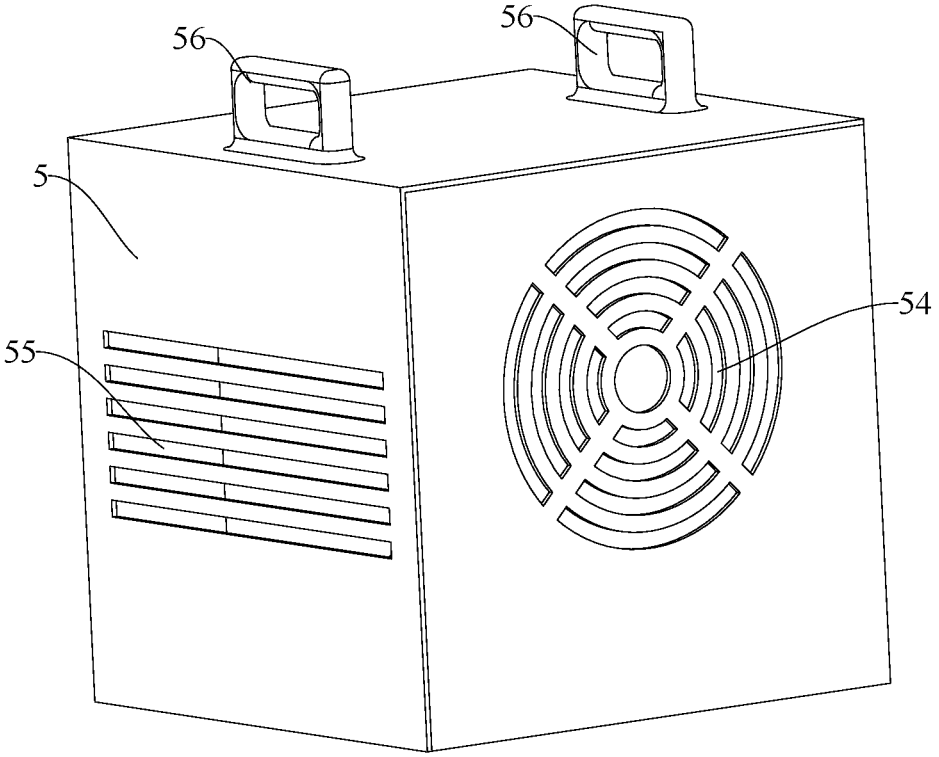
FIGS. 15 to 18 are schematic structural diagrams of a desktop air conditioner according to an embodiment of the present disclosure.
Figure 16:
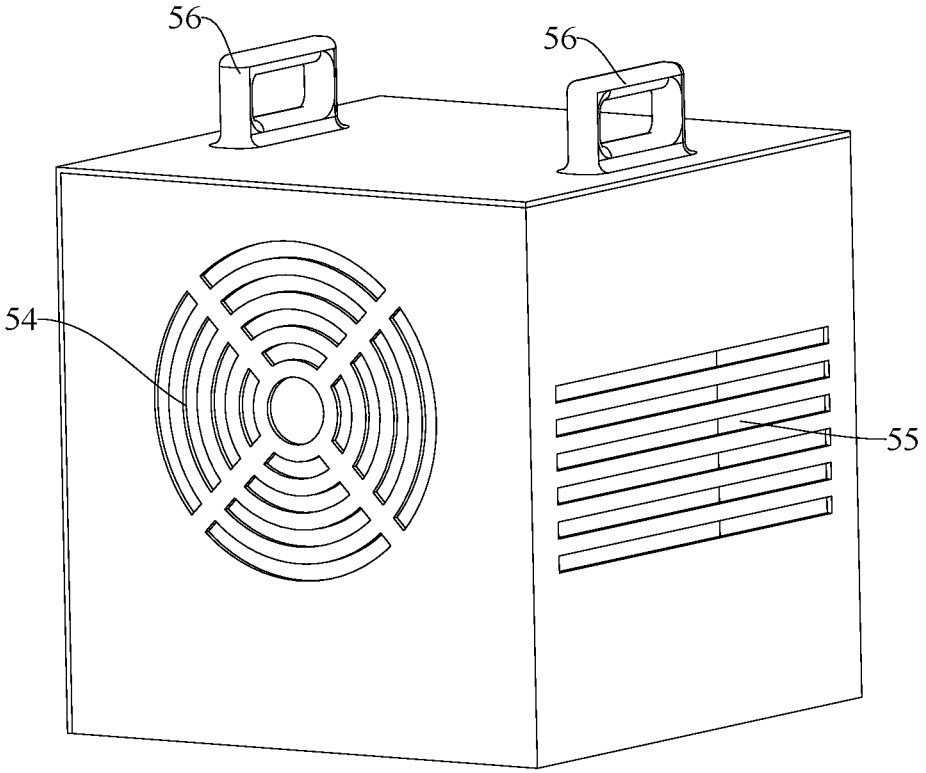

As shown in FIG. 15, the air supply port 54 is provided with louvers to control the air supply direction.

At least one of the air supply port 54 and the air return port 55 is detachable, which is convenient for cleaning.

The first heat exchanger 31 is an air-cooled heat exchanger. The first heat exchanger 31 is connected to the front wall of the box 5, and the first heat exchanger 31 is located directly in a rear side of the supply opening 54. Thereby, the movement of the air flow is smooth and the heat exchange efficiency is high.

In some alternative embodiments, as shown in FIG. 9, the box 5 is of a cuboid shape, and the phase-change thermal-storage heat exchanger 1 and the compressor 2 are disposed in a rear side of the box 5 and spaced apart from each other in the left-to-right direction. The first heat exchanger 31 is provided in a front side of the box 5. Correspondingly, a length, a width and a height of the box 5 are a, b and c, respectively and the following conditions are satisfied: $0.5a<b\leq a$, $0.5b\leq c\leq 2b$, $0.3a\leq c\leq 2a$.

Figure 17:
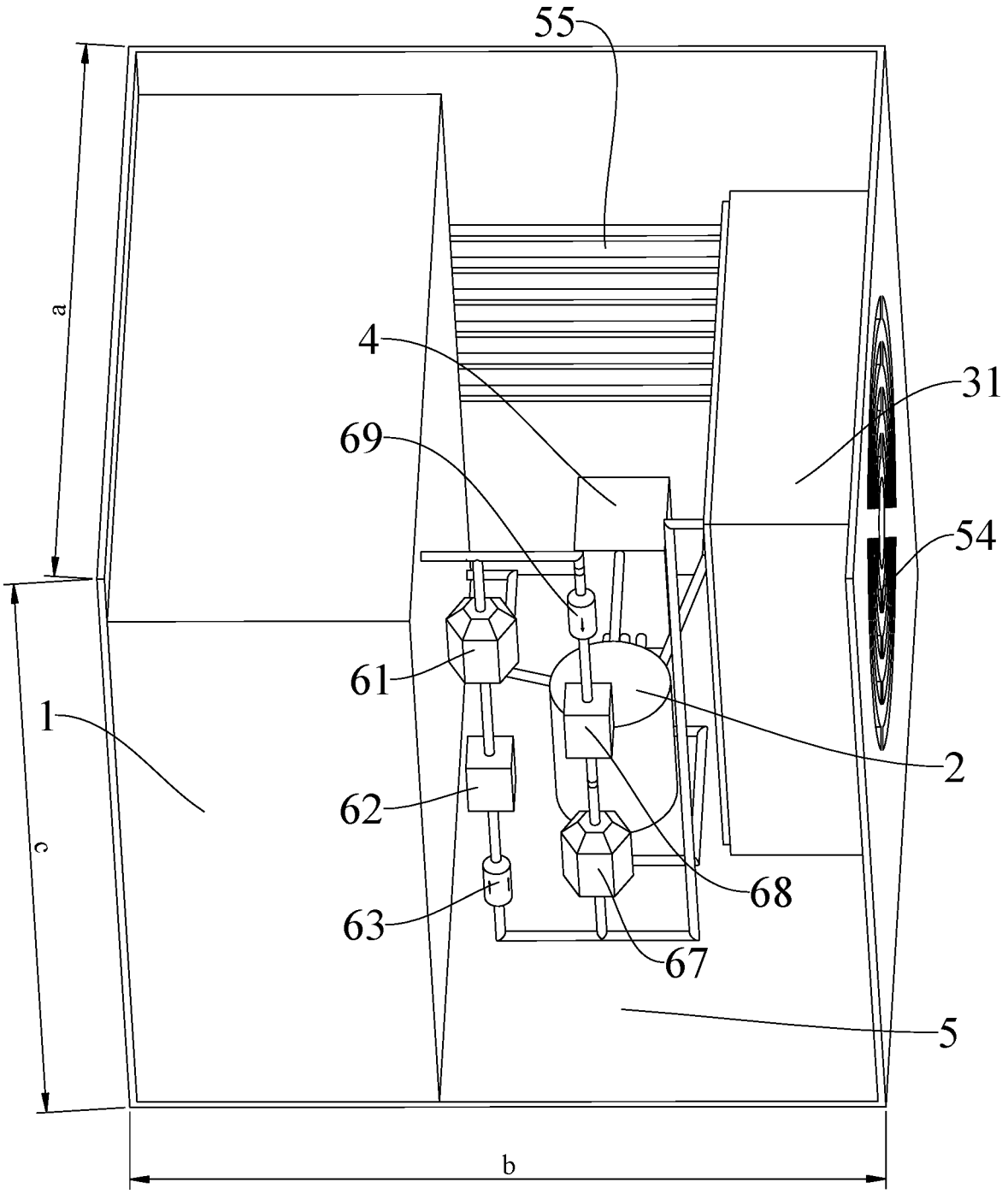
Figure 18:
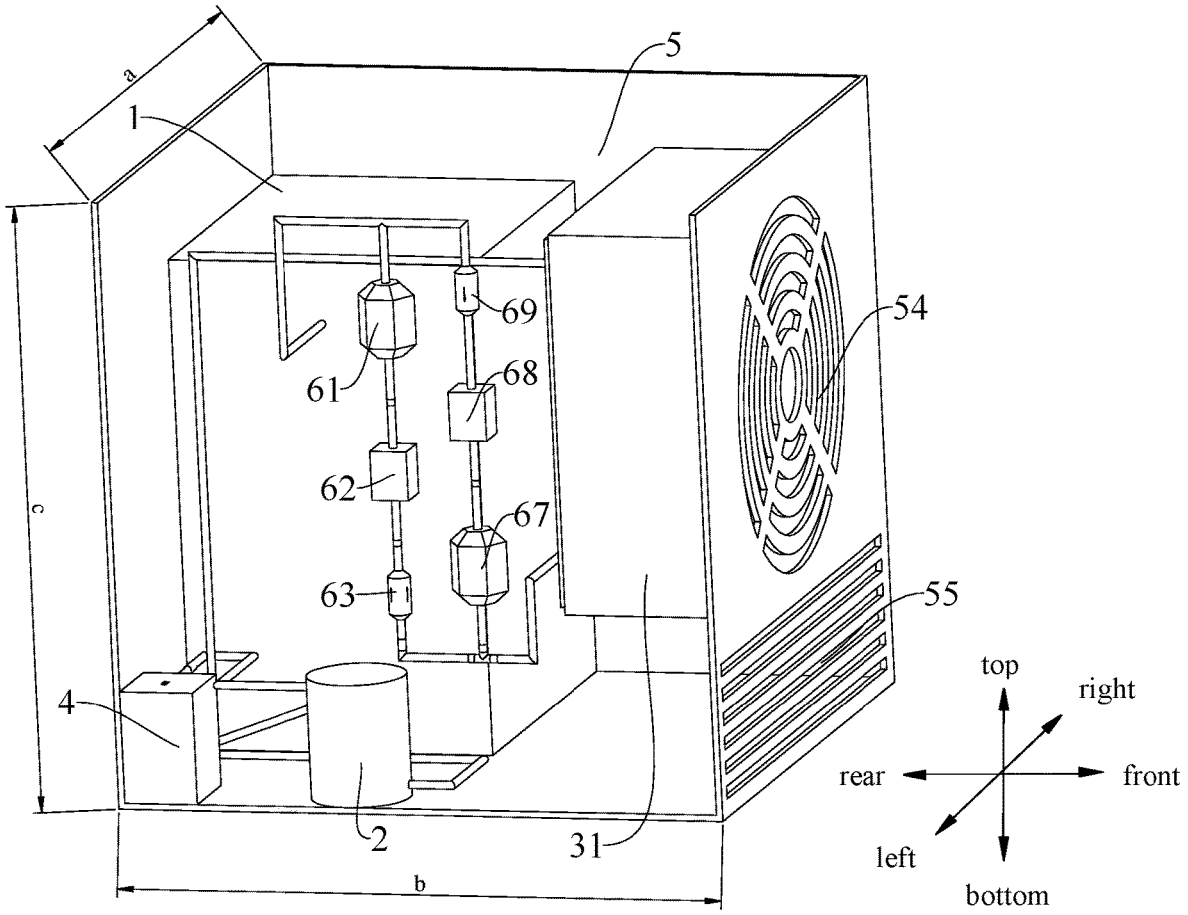

In other optional embodiments, as shown in FIGS. 17 and 18, the box 5 is of a cuboid shape. The phase-change thermal-storage heat exchanger 1 is provided in a rear side of the box 5. The first heat exchanger 31 is provided in a front side of the box 5. The compressor 2 and pipelines of the refrigerant circuit are provided between the phase-change thermal-storage heat exchanger 1 and the first heat exchanger 31. Correspondingly, a length, a width and a height of the box 5 are a, b and c, respectively, and the following conditions are satisfied: $0.5b<a\leq b$, $0.5a\leq c\leq 2a$, $0.3b\leq c\leq 2b$.

It should be noted that front is a side where the air supply port is located. Rear is a direction away from the front. Left is a direction of a left hand of a cooking people when facing the air supply port. Right is a direction of a right hand of the cooking people when facing the air supply port. Top is a direction of the box facing away from the ground. Bottom is a direction of the box close to the ground. The sides include a left side and a right side. In a specific embodiment, the box 5 may be designed of a cube shape, or a cuboid shape having substantially equal length, width and height.

As shown in FIG. 1 and FIG. 18, the desktop air conditioner according to some preferred embodiments of the present disclosure further includes a reversing unit 4. For the specific structure of the reversing unit 4 and the specific structure of the throttling device, reference may be made to the description of the ceiling-mounted air conditioner. The operating principle of the desktop air conditioner can also refer to the description of the ceiling-mounted air conditioner.

Referring to FIGS. 1 and 19 to 23, an air conditioner according to illustrate embodiments of the present disclosure is described. The air conditioner may be used in an indoor environment such as a kitchen or a bedroom etc. The air conditioner may be portable.

As shown in FIGS. 1 and 19 to 23, the air conditioner according to an embodiment of the present disclosure includes a compressor 2, a first heat exchanger 31, a phase-change thermal-storage heat exchanger 1, a reversing unit 4, and a throttling device, a temperature sensor 81, a human body sensor 82, a fan (not shown in figures), a control module and a box 5.

The compressor 2, the first heat exchanger 31, the reversing unit 4, the phase-change thermal-storage heat exchanger 1 and the throttling device are all disposed in the box 5, and refrigeration system pipes are laid in the box 5 as well. In other words, the air conditioner has an integrated structure of which the overall structure is more compact. There is no need to separately install an indoor unit and an outdoor unit, which facilitates the installation.

The compressor 2, the phase-change thermal-storage heat exchanger 1, the throttling device, the reversing unit 4 and the first heat exchanger 31 are communicated to form a refrigerant circuit. The compressor 2, the phase-change thermal-storage heat exchanger 1, the throttling device and the first heat exchanger 31 are capable of being communicated with each other through copper pipes.

The box 5 has an air supply port 54 and an air return port 55. The first heat exchanger 31 is provided between the air supply port 54 and the air return port 55. During work, air enters and exits the box 5 through the air return port 55 and the air supply port 54. The fan is used to promote the circulation of the air inside and outside the box 5 and exchange heat with the first heat exchanger 31 to achieve indoor air temperature adjustment. For example, the first heat exchanger 31 may be an air-cooled heat exchanger. The fan of the air-cooled heat exchanger draws outside air into the box 5 and exchanges heat with the refrigerant in the first heat exchanger 31 and blows it into the room from the air supply port 54.

The compressor 2 has an outlet 22 and an inlet 21. The heat-exchanged refrigerant can enter the compressor 2 from the inlet 21, and the refrigerant can be discharged from the outlet 22 after being compressed by the compressor 2. It should be noted that the structure and working principle of the compressor 2 are well known to those skilled in the art, therefore it will not be described in detail here.

Figure 20:
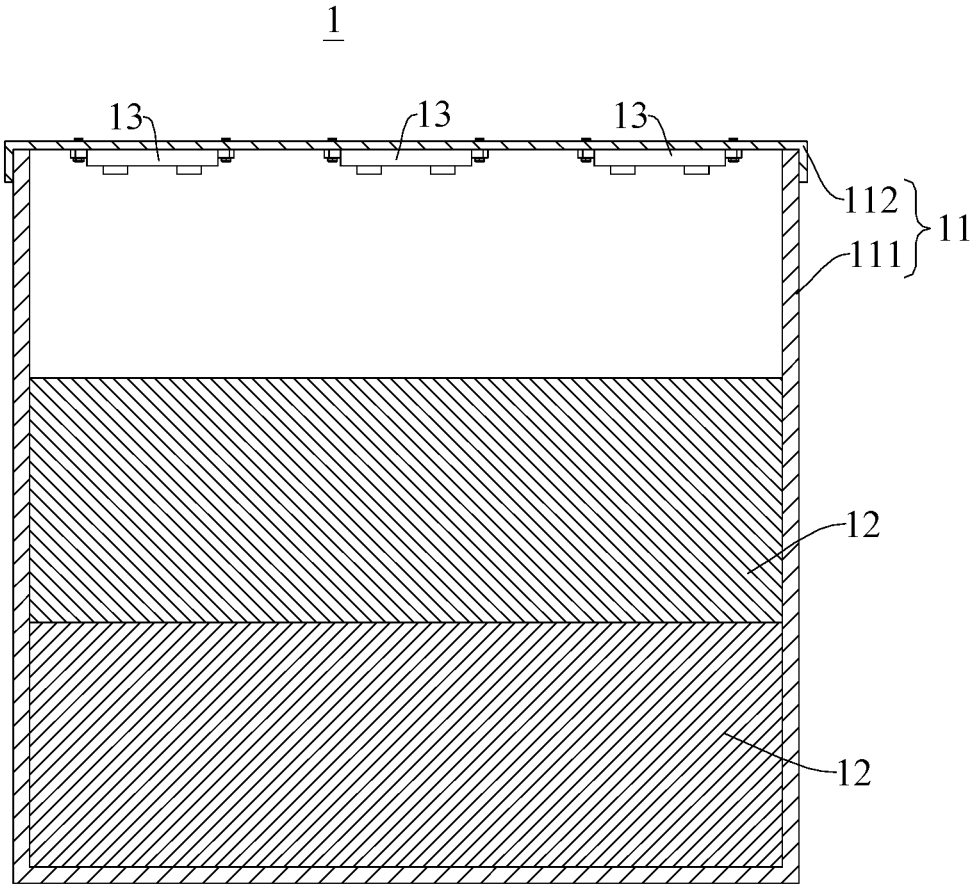
FIG. 20 is a schematic structural diagram of a phase-change thermal-storage heat exchanger according to an embodiment of the present disclosure.
Figure 21:
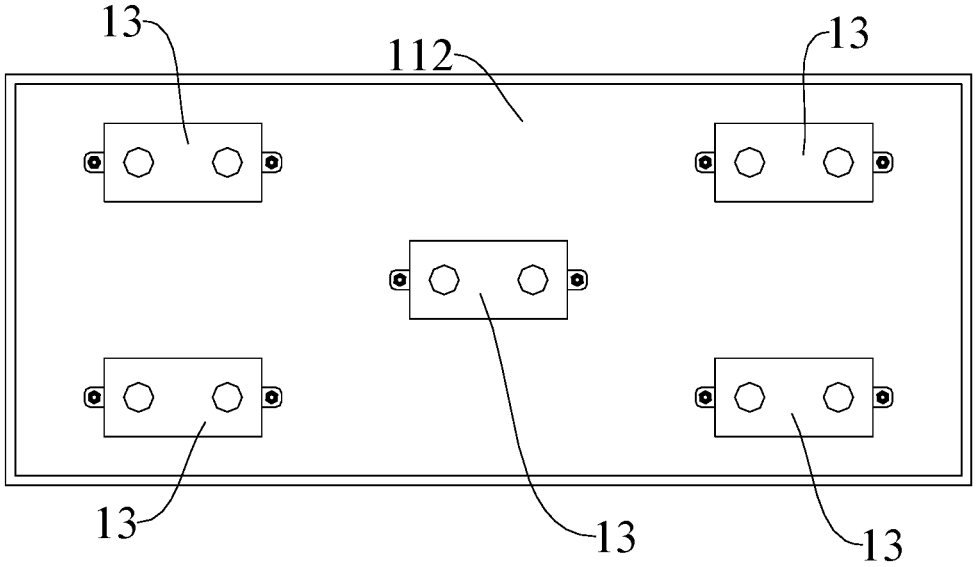
FIG. 21 is a schematic structural diagram of a plurality of distance sensors installed on an upper cover according to an embodiment of the present disclosure.

As shown in FIG. 20, the phase-change thermal-storage heat exchanger 1 includes a packaging container, a distance sensor 13, a phase change medium 12 and a built-in heat exchanger (not shown in the figures). The packaging container is filled with the phase change medium 12. The built-in heat exchanger is disposed in the packaging container for exchanging heat with the phase change medium 12. The phase-change thermal-storage heat exchanger 1 has a sensor for detecting corresponding one-phase content of the phase change medium 12. For example, the sensor may include the distance sensor 13 provided at a top wall of the packaging container, and the distance sensor 13 faces the phase change medium 12. The distance sensor 13 is used to detect a height of a top surface of the phase change medium 12. The distance sensor 13 may be an infrared ranging sensor, an ultrasonic ranging sensor, or the like.

It can be understood that when the built-in heat exchanger exchanges heat with the phase change medium 12, the composition of the phase change medium 12 will change. For example, in FIG. 20, the phase change medium 12 includes a solid phase and a liquid phase. The density of the phase change medium 12 under the solid phase and under the liquid phase is different, resulting in a change in total volume of the phase change medium 12, that is, the height of the phase change medium 12 changes. By detecting the change in height of the phase change medium 12 by the distance sensor 13, various contents of the phase change medium 12 can be represented.

Preferably, as shown in FIG. 20, the packaging container 11 includes a casing 111 and an upper cover 112. An upper side of the casing 111 is opened and the built-in heat exchanger is installed in the casing 111. The casing 111 is filled with the phase change medium 12 so that the built-in heat exchanger is covered by the heat exchange medium. The upper cover 112 closes the casing 111. The distance sensor 13 is mounted on a lower surface of the upper cover 112. For example, the distance sensor 13 may be connected to the upper cover 112 by a threaded fastener. There may be a plurality of distance sensors 13, and the plurality of distance sensors 13 are distributed on the upper cover 112 at a distance from each other. Measurement errors are reduced by detecting the height of multiple regions on the top surface of the heat exchange medium. Specifically, the upper cover 112 is of a rectangular shape. Four of the plurality of distance sensors 13 are distributed at four corners of the upper cover 112, and another distance sensor 13 is installed in the middle of the upper cover 112.

For example, the air conditioner may also include a control module, an alarm and a display. The control module is connected to the distance sensor 13 to detect the content of the phase change medium 12. The alarm is connected to the control module to issue an alarm when corresponding one-phase content of the phase change medium 12 reaches a predetermined value. The display is connected to the control module to display at least one phase content of the phase change medium 12. The control module is configured to receive the height information of the phase change medium 12 detected by the distance sensor 13 and convert it into the content of the liquid and solid phase change medium 12. The content of each phase of the phase change medium 12 represents the time during which the air conditioner can still operate. For example, in summer, the display may display the solid phase content of the phase change medium 12, and when the solid phase content of the phase change medium 12 reaches a predetermined value, an alarm may be issued to alert the user. The alarm can be a buzzer or the like.

The reversing unit 4 includes a first port 41, a second port 42, a third port 43 and a fourth port 44. The compressor 2 has an inlet 21 and an outlet 22. The outlet 22 is communicated with the first port 41 and the inlet 21 is communicated with the third port 43. One end of the first heat exchanger 31 is communicated with the second port 42. One end of the built-in heat exchanger of the phase-change thermal-storage heat exchanger 1 and the other end of the first heat exchanger 31 are communicated via a throttling device. The other end of the built-in heat exchanger of the phase-change thermal-storage heat exchanger 1 is communicated with the fourth port 44.

The first port 41 may be communicated with one of the second port 42 and the fourth port 44, and the third port 43 may be communicated with the other of the second port 42 and the fourth port 44. For example, when the first port 41 is communicated with the second port 42, the third port 43 is communicated with the fourth port 44. When the first port 41 is communicated with the fourth port 44, the third port 43 is communicated with the second port 42. Thereby, the air conditioner can be switched between a cooling mode and a heating mode. Alternatively, the reversing unit 4 may be a four-way reversing valve, but is not limited thereto.

When the refrigerant flows through the first heat exchanger 31, it performs heat exchange with air to achieve the purpose of cooling or heating. After the refrigerant enters the phase-change thermal-storage heat exchanger 1, it can exchange heat with the phase change medium 12 in the phase-change thermal-storage heat exchanger 1. After the phase change medium 12 absorbs or releases heat, it realizes the storage and release of heat by changing its phase state. The refrigerant does not need to perform heat exchange with the environment after exchanging heat in the phase-change thermal-storage heat exchanger 1, which makes it unnecessary for the air conditioner to release heat to the environment during cooling, and unnecessary to absorb heat from the environment during heating. As a result, an integrated structure of the air conditioner can be realized, which breaks the tradition of the split structure of the traditional air conditioner.

For example, when the inlet 21 is communicated with the first end of the first heat exchanger 31 and the outlet 22 is communicated with the first end of the phase-change thermal-storage heat exchanger 1, the air conditioner can provide the user with cooling capacity. The high-temperature and high-pressure gaseous refrigerant discharged from the outlet 22 and flows to the phase-change thermal-storage heat exchanger 1. The refrigerant in the phase-change thermal-storage heat exchanger 1 exchanges heat with the phase change medium 12 to form a liquid refrigerant and flows from the phase-change thermal-storage heat exchanger 1 to the throttling device. The refrigerant is throttled and depressurized by the throttling device to form a low-temperature and low-pressure refrigerant and flows to the first heat exchanger 31. The refrigerant exchanges heat with air in the first heat exchanger 31 to provide the user a cooling capacity and form a gaseous refrigerant. Then, the refrigerant returns from the inlet 21 to the compressor 2.

Accordingly, when the inlet 21 is communicated with the first end of the phase-change thermal-storage heat exchanger 1 and the outlet 22 is communicated with the first end of the first heat exchanger 31, the air conditioner can provide heat to the user.

Specifically, when the air conditioner is operating in a cooling mode, the first port 41 of the reversing unit 4 is communicated with the fourth port 44, and the third port 43 is communicated with the second port 42. It circulates in a way that the refrigerant flows through the outlet 22 of the compressor 2, the first port 41, the fourth port 44 of the reversing unit 4, the build-in heat exchanger of the phase-change thermal-storage heat exchanger 1, the throttling device, the first heat exchanger 31, the second port 42 and the third port 43 of the reversing unit 4, and refrigerant finally returns from the inlet 21 of the compressor 2 into the compressor 2. At this time, the first heat exchanger 31 is an evaporator, and the build-in heat exchanger of the phase-change thermal-storage heat exchanger 1 is a condenser. When the refrigerant flows through the build-in heat exchanger of the phase-change thermal-storage heat exchanger 1, it exchanges heat with the phase change medium 12. The heat released by the refrigerant is absorbed and stored by the phase change medium 12, and the state of the phase change medium 12 changes, such as from a solid state to a liquid state. When the refrigerant flows through the first heat exchanger 31, it performs heat exchange with the air and absorbs the heat in the air to achieve the purpose of cooling.

When the air conditioner is operating in a heating mode, the direction of refrigerant flow can be switched by the reversing unit 4. The first port 41 of the reversing unit 4 is communicated with the second port 42, and the third port 43 is communicated with the fourth port 44. In this process, it circulates in a way that the refrigerant flows through the outlet 22 of the compressor 2, the first port 41 and the second port 42 of the reversing unit 4, the first heat exchanger 31, the throttling device, the build-in heat exchanger of the phase-change thermal-storage heat exchanger 1, the fourth port 44 and the third port 43 of the reversing unit 4, and the refrigerant finally returns from the inlet 21 of the compressor 2 into the compressor 2. At this time, the build-in heat exchanger of the phase-change thermal-storage heat exchanger 1 is an evaporator, and the first heat exchanger 31 is a condenser. When the refrigerant flows through the build-in heat exchanger of the phase-change thermal-storage heat exchanger 1, the refrigerant and the phase change medium 12 exchange heat. The refrigerant absorbs the heat stored in the phase change medium 12, and the state of the phase change medium 12 changes, such as from a liquid state to a solid state. When the refrigerant flows through the first heat exchanger 31, it performs heat exchange with the air to release heat to the air, thereby achieving the purpose of heating.

During the cooling operation of the air conditioner, the phase change medium 12 absorbs and stores the condensation heat, and its state changes from solid to liquid. When the phase change medium 12 is completely changed to a liquid state, its heat storage capacity reaches the upper limit. At this time, the air conditioner cannot continue to perform cooling. The air conditioner needs to start a first regeneration process to restore the heat storage capacity of the phase change medium 12. Of course, when the phase change medium 12 is not completely converted to a liquid state, if the cooking is completed, the first regeneration process may also be started to maximize the heat storage capacity of the phase-change thermal-storage heat exchanger 1. This process is similar to battery charging, which can change the phase change medium 12 from a liquid state to a solid state in a short time, and restore the heat storage capacity so that the air conditioner can continue to perform cooling. The first regeneration process of the phase change medium 12 is realized by stopping the refrigeration cycle of the air conditioner and then starting the heating cycle of the air conditioner to make the refrigerant absorb the heat stored in the phase change medium 12 and restore the heat storage capacity. The regeneration process can be started when the air conditioner does not need refrigeration, for example, it can be started at night. Because hot air will be sent to the kitchen during the first regeneration process, doors and windows connecting the kitchen and the indoor room need to be closed to prevent heat from entering other spaces in the room. Windows connecting a space where the air conditioner is located and the outdoor can be opened for air circulation, and the outdoor air can also remove heat from the kitchen. Of course, when the air conditioner is a portable air conditioner, the above process can be performed outdoors to avoid the cold air from the air conditioner from affecting the indoor air condition.

During the cooling operation of the air conditioner, the display may show the solid phase content of the phase change medium 12. When the solid phase content of the phase change medium 12 reaches a predetermined value, the alarm issues an alarm to prompt the user. The alarm can be a buzzer or the like.

Similarly, during the heating operation of the air conditioner, the phase change medium 12 changes from a liquid state to a solid state because the refrigerant absorbs heat from the phase change medium 12. When the phase change medium 12 is completely converted to a solid state, its heat release capacity reaches the upper limit, and the air conditioner cannot continue to perform heating at this time. The air conditioner needs to start a second regeneration process to restore the heat release capacity of the phase change medium 12. Of course, when the phase change medium 12 is not completely converted to a solid state, if the cooking is completed, the second regeneration process may also be started to maximize the heat release capacity of the phase-change thermal-storage heat exchanger 1. The second regeneration process is opposite to the above-mentioned first regeneration process, which can change the phase change medium 12 from a solid state to a liquid state in a short time, and restore the heat release capability so that the air conditioner can continue to perform heating. The implementation method is to stop the heating cycle of the air conditioner and start the refrigeration cycle of the air conditioner. In the process, the phase change medium 12 absorbs and stores the heat of condensation, and changes from a solid state to a liquid state, thereby restoring the heat release capability. This second regeneration process is usually started when the air conditioner does not require to perform heating. Since cold air will be sent during the second regeneration process, it is necessary to close windows, which connect a space where the air conditioner is located and the indoor room, to prevent the cold air from entering other spaces in the room. Windows connecting the space where the air conditioner is located and the outdoor can be opened for air circulation. Of course, when the air conditioner is a portable air conditioner, the above process can be performed outdoors to avoid the cold air from the air conditioner from affecting the indoor air condition.

During the heating operation of the air conditioner, the display may show the solid phase content of the phase change medium 12. When the solid phase content of the phase change medium 12 reaches a predetermined value, the alarm issues an alarm to prompt the user. The alarm can be a buzzer or the like.

Figure 19:
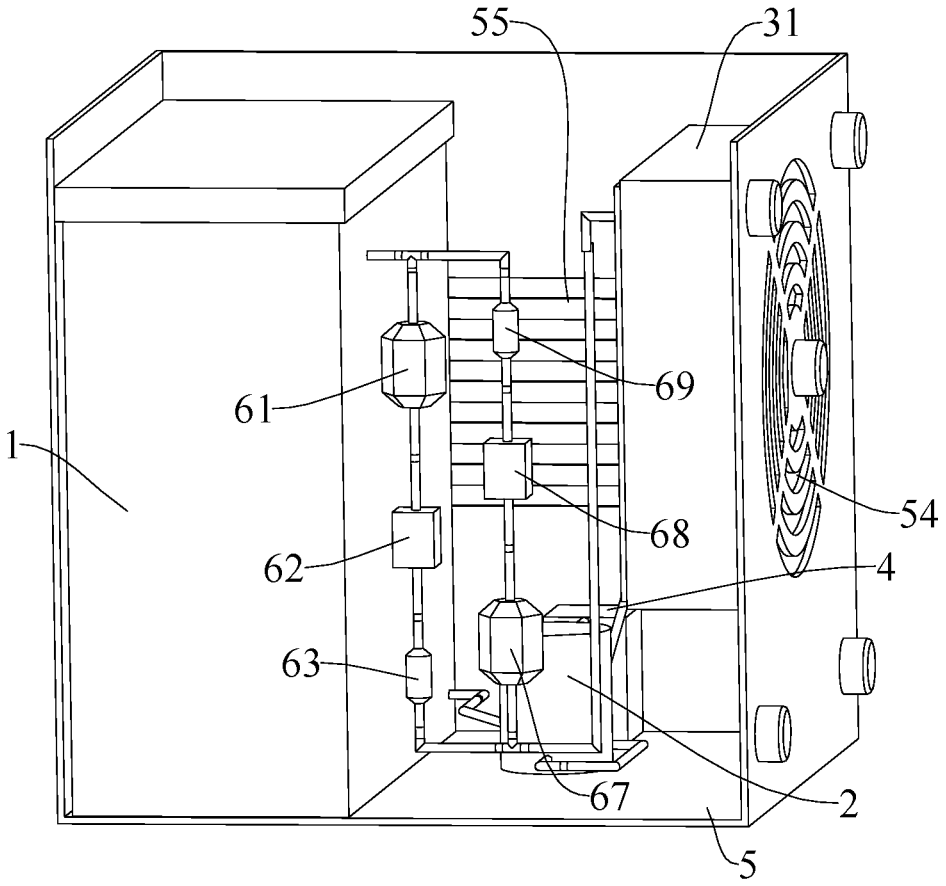
FIG. 19 is a schematic structural diagram of an air conditioner according to an embodiment of the present disclosure.

According to some embodiments of the present disclosure, referring to FIGS. 1 and 19, the throttling device includes a first throttling element 63 and a third throttling element 69. The air conditioner further includes a first throttle branch and a third throttle branch. A first check valve 61 is provided in the first throttle branch, and a third check valve 67 is provided in the third throttle branch.

Specifically, one end (for example, a left end in FIG. 1) of the first throttle branch is communicated with the first heat exchanger 31, and the other end (for example, a right end in FIG. 1) of the first throttle branch is communicated with the build-in heat exchanger of the phase-change thermal-storage heat exchanger 1. The first throttling element 63 is communicated in series with the first check valve 61 in the first throttle branch. The first check valve 61 is located at one end of the first throttling element 63 adjacent to the build-in heat exchanger of the phase-change thermal-storage heat exchanger 1 so that the refrigerant in the build-in heat exchanger of the phase-change thermal-storage heat exchanger 1 flows to the first throttling element 63. A first drying filter 62 may be further provided between the first throttling element 63 and the first check valve 61, and the first drying filter 62 is configured to absorb moisture in the refrigerant.

The third throttle branch and the first throttle branch are connected in parallel between the first heat exchanger 31 and the build-in heat exchanger of the phase-change thermal-storage heat exchanger 1. The third throttling element 69 and the third check valve 67 are communicated in series in the third throttle branch. The third check valve 67 is located at an end of the third throttling element 69 adjacent to the first heat exchanger 31 so that the refrigerant in the first heat exchanger 31 flows to the third throttling element 69. A third drying filter 68 may be further provided between the third throttling element 69 and the third check valve 67, and the third drying filter 68 is used to absorb moisture in the refrigerant.

Therefore, the refrigerant in the cooling process can be throttled and depressurized by the first throttling element 63, and the refrigerant in the heating process can be throttled and depressurized by the third throttling element 69. As a result, different throttling elements can be used to throttle and depressurize the refrigerant in the cooling process and the heating process, respectively. The effect of throttling and depressurizing is guaranteed, and the cooling performance and heating performance of the air conditioner are improved.

Alternatively, the first throttling element 63 and the third throttling element 69 may be capillaries, thermal expansion valves, electronic expansion valves, or the like.

Figure 22:
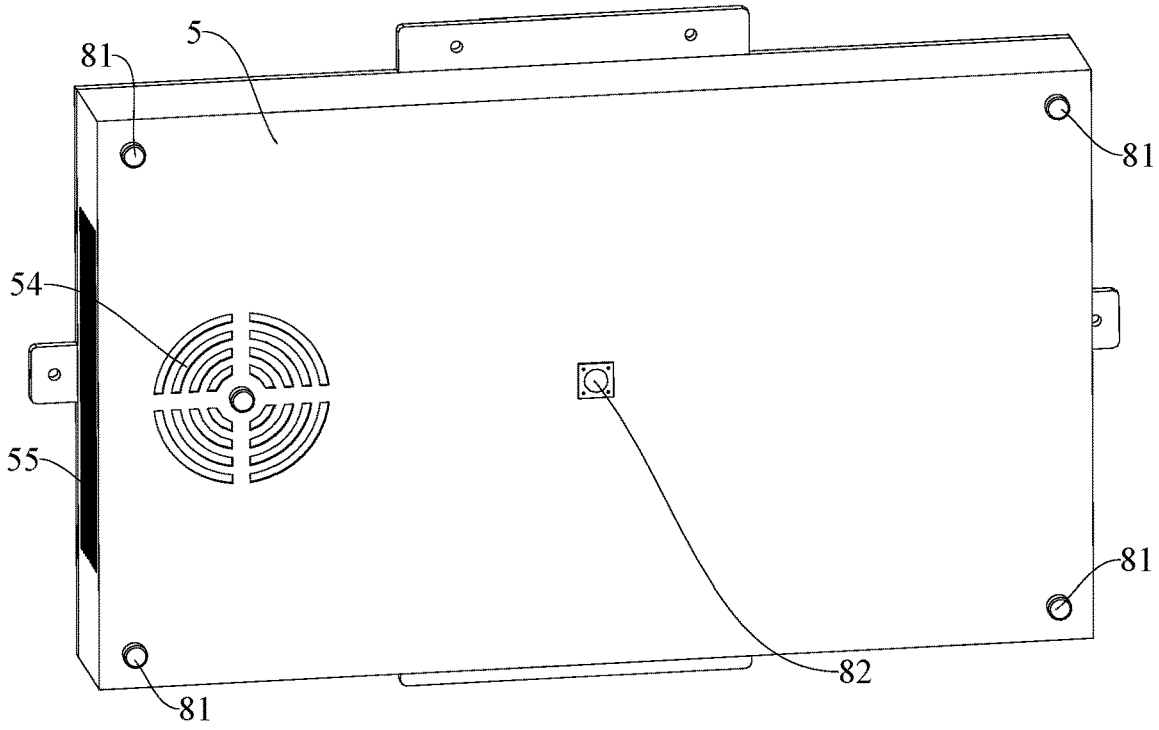
FIGS. 22 and 23 are schematic diagrams of an external structure of an air conditioner according to an embodiment of the present disclosure.
Figure 23:
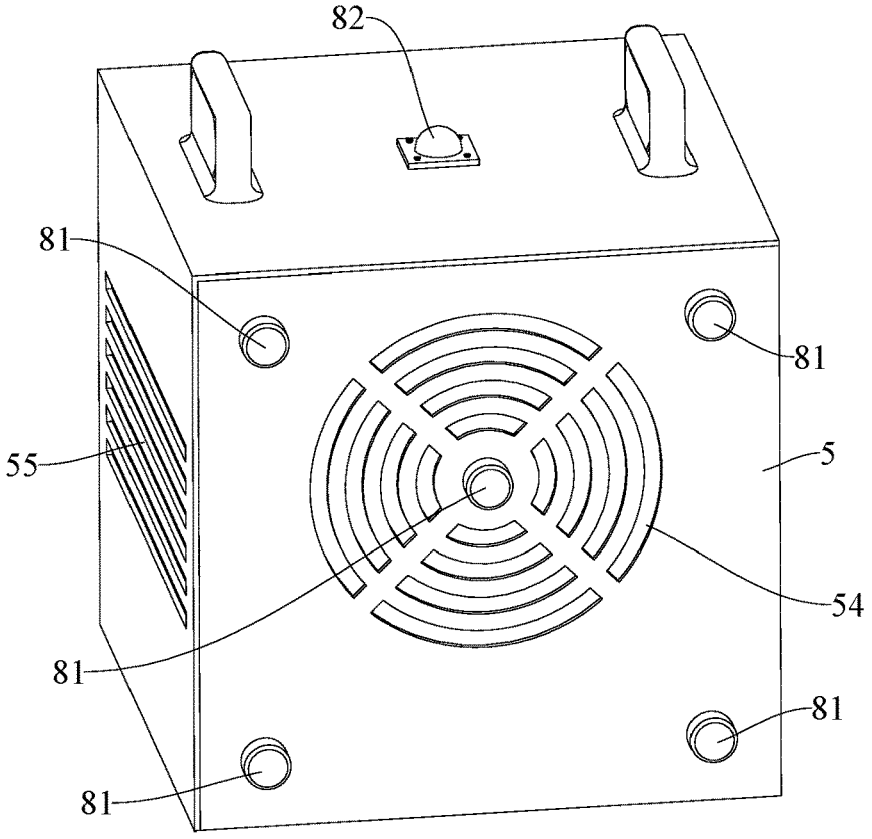

The distance sensor 13, the temperature sensor 81, the human body sensor 82, the compressor and the fan are all electrically connected to the control module. The temperature sensor 81 is used to detect the ambient temperature. As shown in FIGS. 22 and 23, there are a plurality of temperature sensors 81, and the plurality of temperature sensors 81 are spaced apart and distributed outside the box. At least one of the plurality of temperature sensors 81 is installed at the air supply port of the air conditioner, and other temperature sensors 81 are distributed around the box to improve the accuracy of temperature detection. The human body sensor 82 is used to detect whether there are any people around, and the range is within a radius of 2 m to 7 m, which can basically cover a regular room. In order to make the detection of the human body sensor 82 more sensitive, the human body sensor 82 should be installed horizontally.

In this way, the control module of the air conditioner is configured to control the working status of the compressor and the fan based on an ambient temperature information detected by the temperature sensor 81, an information detected by the human body sensor 82 about whether there are any people around, and a composition information of the phase change medium 12 provided by the phase-change thermal-storage heat exchanger.

According to the air conditioner in the embodiment of the present disclosure, it is not necessary to release heat to the environment during cooling, and it is not necessary to absorb heat from the environment during heating. As a result, an integrated design of the air conditioner is realized, and the operation is highly intelligent.

Figure 24:
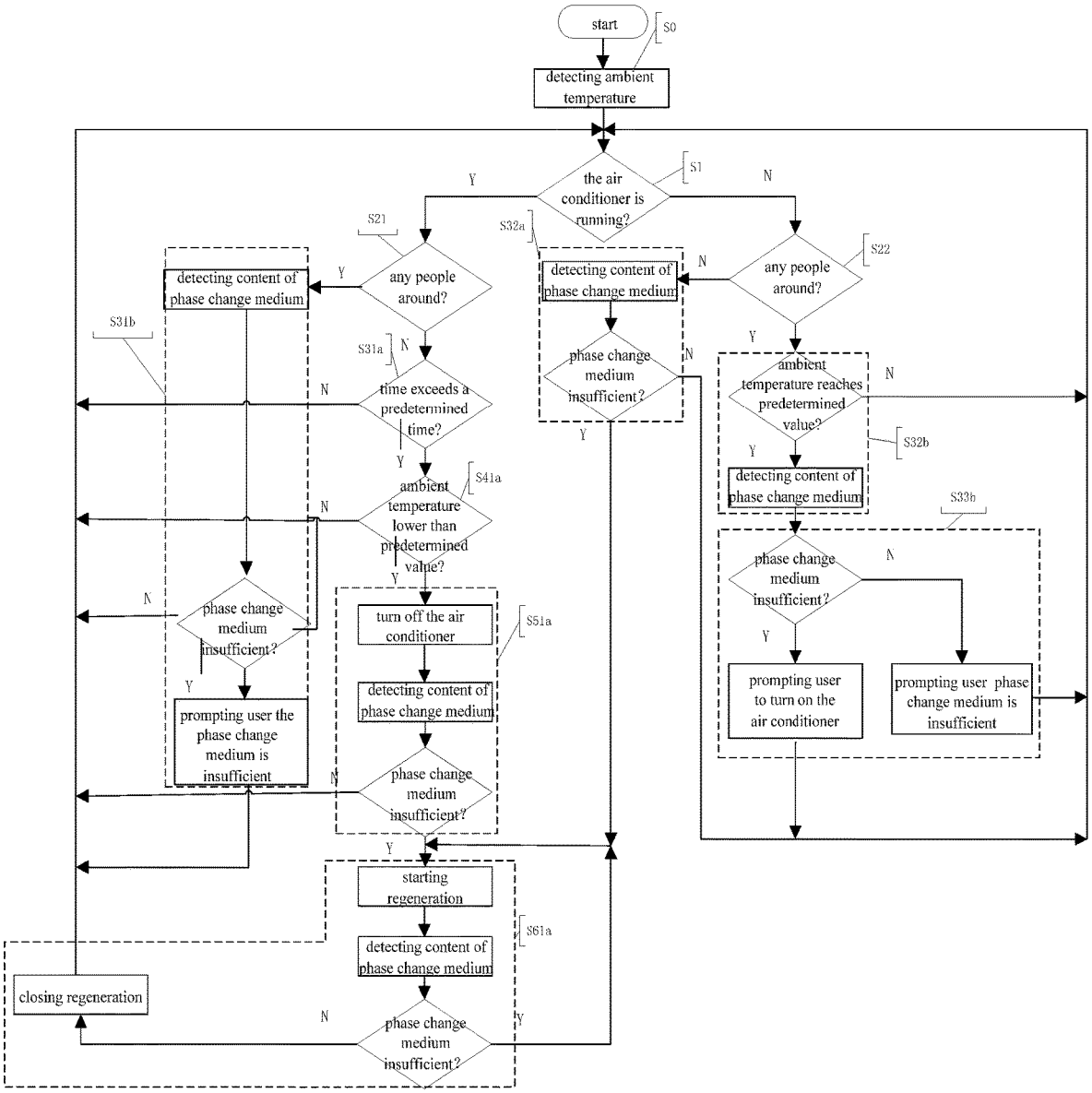
FIG. 24 is a control strategy logic diagram of a non-movable air conditioner according to an embodiment of the present disclosure.
Figure 25:
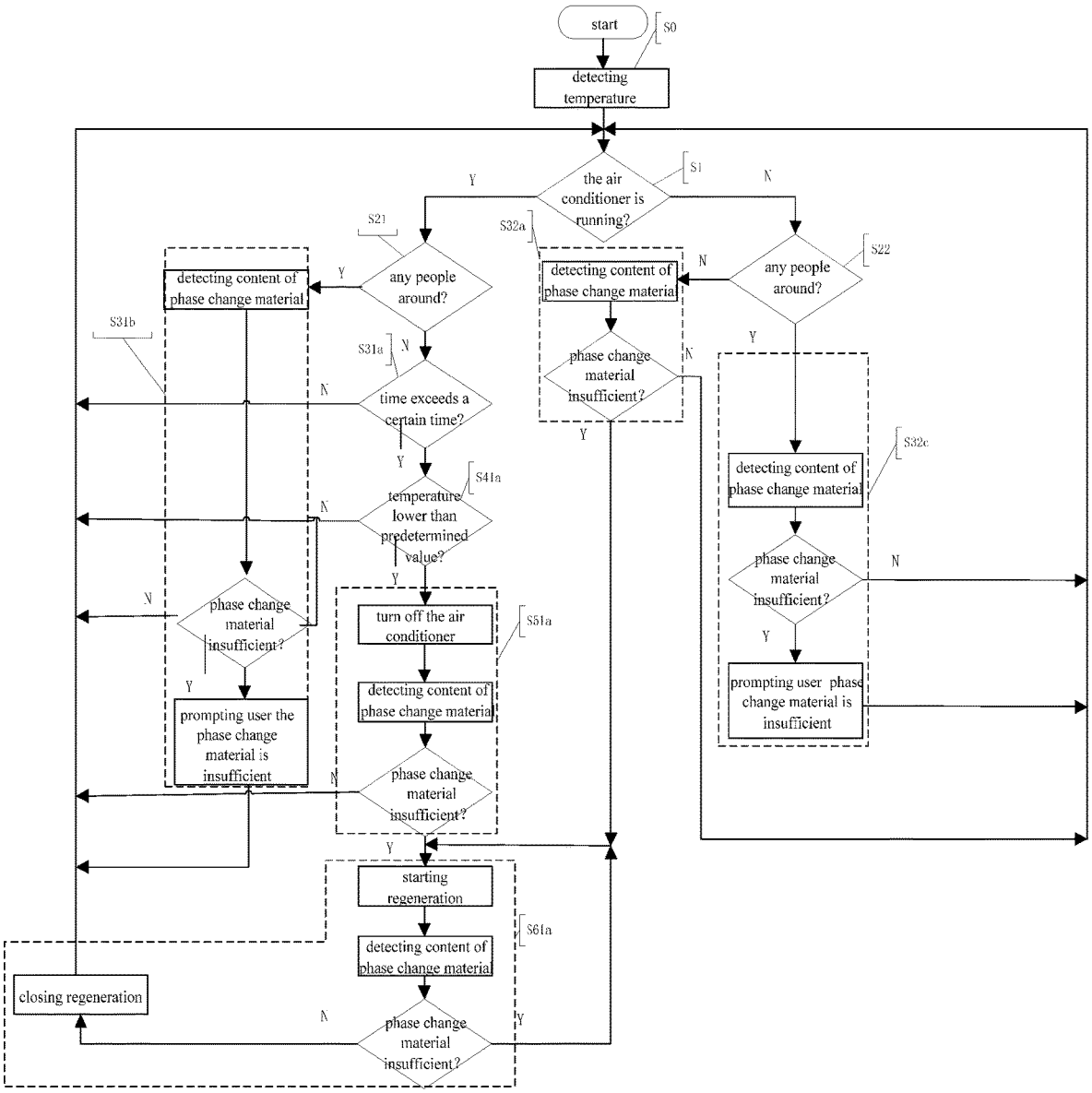
FIG. 25 is a control strategy logic diagram of a movable air conditioner according to an embodiment of the present disclosure.

The present disclosure also discloses a control strategy of an air conditioner, and the air conditioner is the air conditioner of any one of the foregoing embodiments. Referring to FIGS. 24 and 25, the control strategy includes the following steps: S0, detecting the ambient temperature, S1, determining whether the air conditioner is running; S21, if the air conditioner is running, determining whether there is any people around the air conditioner; S31*a*, if there is no people around the air conditioner, determining whether a time without people around exceeds a predetermined time; S41*a*, if the time without people around exceeds the predetermined time, determining whether an ambient temperature reaches a set value; S51*a*, if the ambient temperature reaches the set value, turning off the air conditioner, detecting a corresponding one-phase content of a phase change medium 12 of the phase-change thermal-storage heat exchanger, and determining whether the corresponding one-phase content of the phase change medium 12 is less than a first predetermined amount; and S61*a*, if the corresponding one-phase content of the phase change medium 12 is less than the first predetermined amount, starting a regeneration cycle of the air conditioner; and when the corresponding one-phase content of the phase change medium 12 is greater than a second predetermined amount, turning off the regeneration cycle of the air conditioner.

Preferably, the control strategy of the air conditioner further includes a step after the step S21: S31*b*, if there are any people around the air conditioner, then detecting the corresponding one-phase content of the phase change medium 12; and when the corresponding one-phase content of the phase change medium 12 is less than the first predetermined amount, prompting a user that the corresponding one-phase content of the phase change medium 12 is insufficient.

In the step S31*a*, if the time without people around does not exceed the predetermined time, then return to the step S1; in the step S31*b*, if the corresponding one-phase content of the phase change medium 12 is not less than the first predetermined amount, then return to the step S1; in the step S41*a*, if the ambient temperature does not reach the set value, returning to the step S1; in the step S51*a*, if the corresponding one-phase content of the phase change medium 12 is not less than the first predetermined amount, returning to the step S1; after the step S61*a*, returning to the step S1.

Preferably, the control strategy of the air conditioner further includes the following steps after the step S1: S22, if the air conditioner is not running, determining whether there is any people around the air conditioner; S32*a*, if there is no people around the air conditioner, detecting the corresponding one-phase content of the phase change medium 12 of the phase-change thermal-storage heat exchanger, and determining whether the corresponding one-phase content of the phase change medium 12 is less than the first predetermined amount; if the corresponding one-phase content of the phase change medium 12 is less than the first predetermined amount, executing the step S61*a*.

Preferably, if the corresponding one-phase content of the phase change medium 12 in the step S32*a* is not less than the first predetermined amount, returning to the step S1.

Referring to FIG. 24, for a non-mobile air conditioner, the control strategy of the air conditioner further includes the following steps after the step S22: S32*b*, if there is a people around the air conditioner and the ambient temperature reaches the predetermined value, detecting the corresponding one-phase content of the phase change medium 12; S33*b*, when the corresponding one-phase content of the phase change medium 12 is less than the first predetermined amount, prompting an user that the corresponding one-phase content of the phase change medium 12 is insufficient, and return to the step S1; when the corresponding one-phase content of the phase change medium 12 is not less than the first predetermined amount, prompting the user to turn on the air conditioner.

Referring to FIG. 25, if the air conditioner is a portable air conditioner, the control strategy further includes a step after the step S22: S32*c*, if there is a people around the air conditioner, detecting the corresponding one-phase content of the phase change medium 12; when the corresponding one-phase content of the phase change medium 12 is less than the first predetermined amount, prompting the user that the corresponding one-phase content of the phase change medium 12 is insufficient, and returning to the step S1.

According to the control strategy of the air conditioner in the embodiment of the present disclosure, the intelligence level of the air conditioner is high. The air conditioner can automatically perform the regeneration process, so that when the user uses the composition of the phase change medium 12 of the phase-change thermal-storage heat exchanger, it can meet the demand for use. In addition, the air conditioner can automatically shut down according to temperature and personnel, thus saving energy and protecting the environment.

Figure 26:
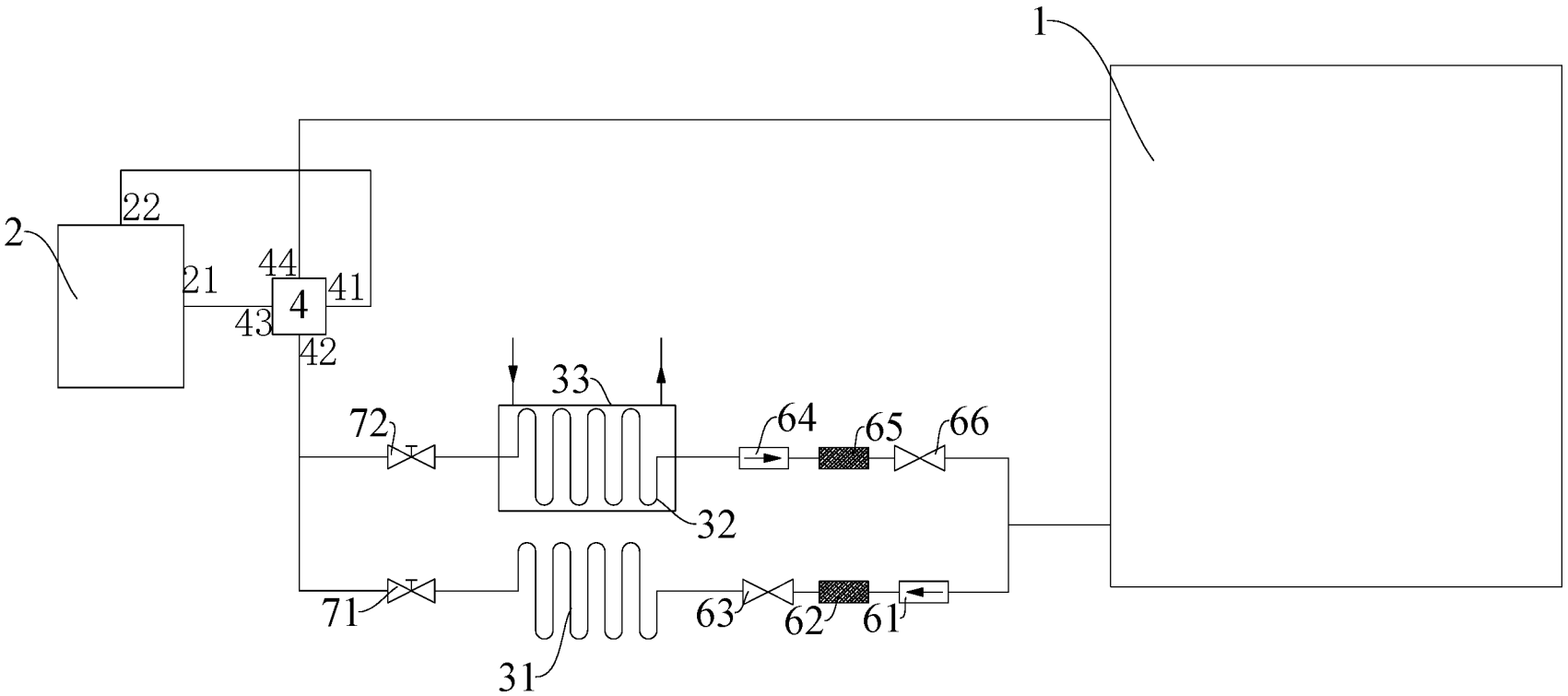
FIGS. 26 to 28 are schematic diagrams of air conditioning systems according to embodiments of the present disclosure.
Figure 27:
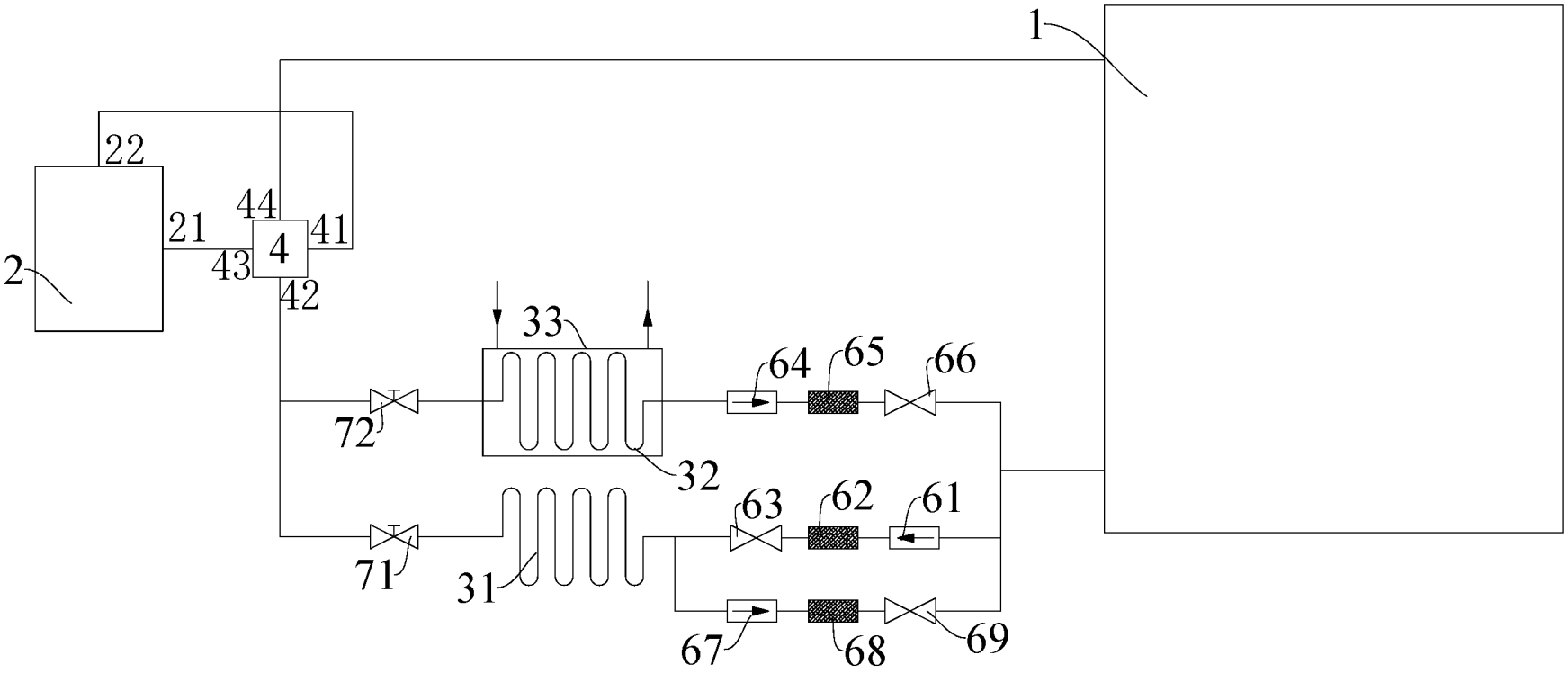
Figure 28:
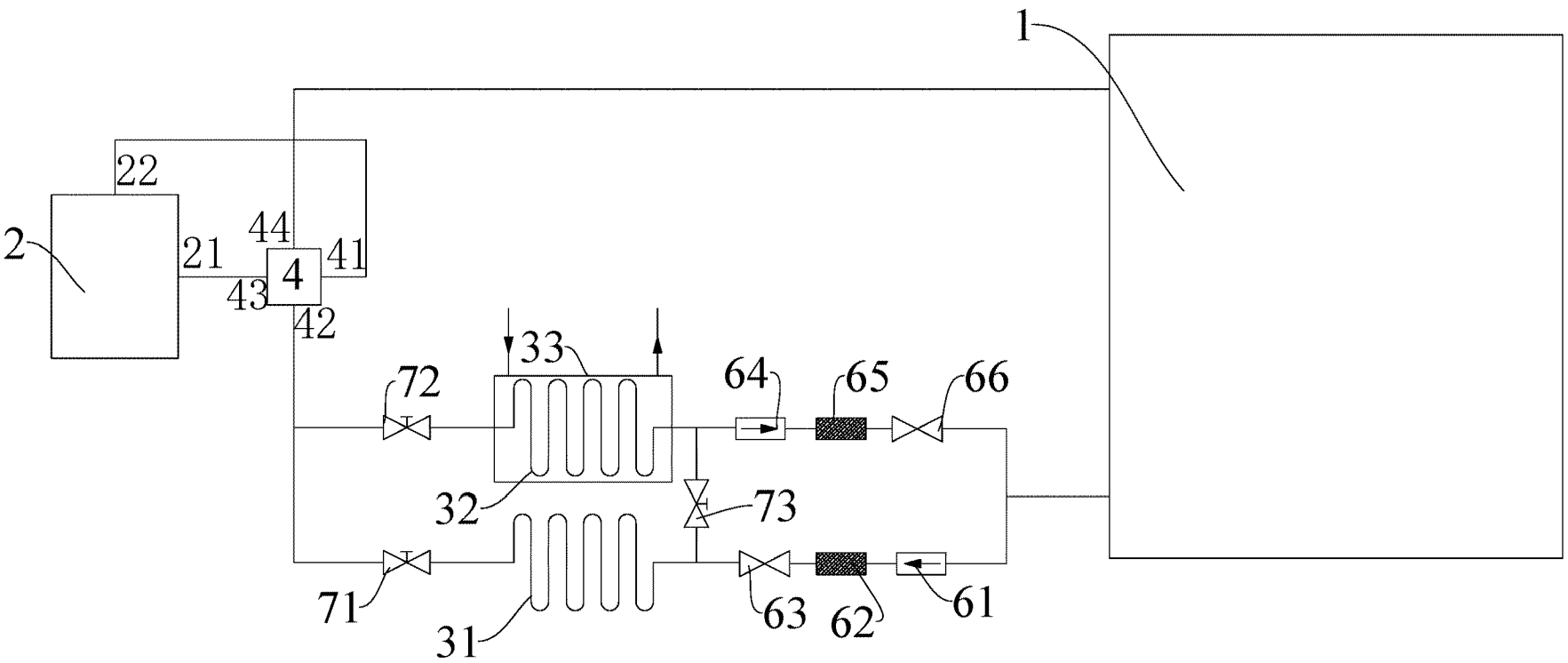

Referring to FIGS. 26 to 28, air conditioners according to embodiments of the present disclosure are described. The air conditioner may be used in an indoor environment such as a kitchen, a bedroom, and the like.

The air conditioner according to embodiments of the present disclosure includes a box and an air conditioning system.

The box has an air supply port and an air return port. The air conditioning system is installed in the box. The air conditioning system is used to realize the circulating cooling effect of the air conditioner.

Firstly, referring to FIGS. 26 to 28, the air conditioning system according to embodiments of the present disclosure will be described.

As shown in FIGS. 26 to 28, the air conditioning system according to an embodiment of the present disclosure includes a reversing unit 4, a compressor 2, a first heat exchanger 31, a first throttling element 63 and a phase-change thermal-storage heat exchanger 1. The reversing unit 4, the compressor 2, the first heat exchanger 31, the first throttling element 63 and the phase-change thermal-storage heat exchanger 1 are all arranged in a box. The refrigeration system pipes are laid in the box. The second heat exchanger 32, the second throttling element 66 and the water tank 33 may be arranged inside the box. In this way, the entire air conditioning system is integrated in the box so that the degree of integration is high. Of course, the second heat exchanger 32, the second throttling element 66 and the water tank 33 can also be arranged outside the box. For example, the air conditioning system is installed in two boxes to suit the layout of the indoor space.

The compressor 2, the phase-change thermal-storage heat exchanger 1, the first throttling element 63 and the first heat exchanger 31 are communicated to form a refrigerant circuit. The compressor 2, the phase-change thermal-storage heat exchanger 1, the first throttling element 63 and the first heat exchanger 31 can be communicated with each other through copper pipes. The compressor 2, the phase-change thermal-storage heat exchanger 1, the second throttling element 66 and the second heat exchanger 32 are communicated to form another refrigerant circuit. The compressor 2, the phase-change thermal-storage heat exchanger 1, the second throttling element 66 and the second heat exchanger 32 can be communicated with each other through copper pipes.

The first heat exchanger 31 is provided between the air supply port and the air return port. During the working process, air enters and exits the box through the air return port and the air supply port, and exchanges heat with the first heat exchanger 31 to achieve indoor air temperature adjustment. For example, the first heat exchanger 31 may be an air-cooled heat exchanger. A fan of the air-cooled heat exchanger draws outside air into the box and exchanges heat with the refrigerant in the first heat exchanger 31, and blows it into the room from the air supply port.

The compressor 2 has an outlet 22 and an inlet 21. The heat-exchanged refrigerant can enter the compressor 2 from the inlet 21, and the refrigerant can be discharged from the outlet 22 after being compressed by the compressor 2. It should be noted that the structure and working principle of the compressor 2 are well known to those skilled in the art, therefore it will not be described in detail here.

The reversing unit 4 includes a first port 41, a second port 42, a third port 43 and a fourth port 44. The outlet 22 is communicated with the first port 41, and the inlet 21 is communicated with the third port 43. One end (for example, an upper end in FIGS. 26 to 28) of the phase-change thermal-storage heat exchanger 1 is communicated with the fourth port 44. One end (for example, a left end in FIGS. 26 to 28) of the first heat exchanger 31 is communicated with the second port 42. The other end (for example, a lower end in FIGS. 26 to 28) of the phase-change thermal-storage heat exchanger 1 and the other end (for example, a right end in FIGS. 26 to 28) of the first heat exchanger 31 are communicated via a first throttling element 63. One end (for example, the left end in FIGS. 26 to 28) of the second heat exchanger 32 is communicated with the second port 42. The other end of the phase-change thermal-storage heat exchanger 1 and the other end (for example, the right end in FIGS. 26 to 28) of the second heat exchanger 32 are communicated via a second throttling element 66.

The first port 41 may be communicated with one of the second port 42 and the fourth port 44, and the third port 43 may be communicated with the other of the second port 42 and the fourth port 44. For example, when the first port 41 is communicated with the second port 42, the third port 43 is communicated with the fourth port 44. When the first port 41 is communicated with the fourth port 44, the third port 43 is communicated with the second port 42. Thereby, the air conditioner can be switched between a cooling mode and a heating mode. Alternatively, the reversing unit 4 may be a four-way reversing valve, but is not limited thereto.

After the refrigerant enters the phase-change thermal-storage heat exchanger 1, it can exchange heat with the phase change medium in the phase-change thermal-storage heat exchanger 1. After the phase change medium absorbs or releases heat, it realizes the storage and release of heat by changing its phase state. The refrigerant does not need to perform heat exchange with the environment after exchanging heat in the phase-change thermal-storage heat exchanger 1, which makes it unnecessary for the air conditioner to release heat to the environment during cooling, and unnecessary to absorb heat from the environment during heating. As a result, an integrated structure of the air conditioner can be realized, which breaks the tradition of the split structure of the traditional air conditioner.

When the refrigerant flows through the first heat exchanger 31, it performs heat exchange with air to achieve the purpose of cooling or heating.

The second heat exchanger 32 is installed in the water tank 33, and the second heat exchanger 32 and the water tank 33 may form a water-cooled heat exchanger. When the refrigerant flows through the second heat exchanger 32, it performs heat exchange with water, so that the water tank 33 can provide hot water. Preferably, the water tank 33 is used for supplying hot water. For example, the water tank 33 may be provided with a water inlet and a water outlet. Cold water flows from the water inlet and flows out from the water outlet after exchanging heat with the refrigerant. The hot water produced can be used for washing dishes, bathing, heating, etc. In conjunction with the water pipe design of the water tank 33, this air conditioning system is more suitable for kitchen ceiling or embedded air conditioning structures.

Referring to FIG. 26, a refrigerant circuit of the air conditioning system is described.

Specifically, when the air conditioning system is operating in a cooling mode, the heat exchange branch where the first heat exchanger 31 is located is communicated, and the heat exchange branch where the second heat exchanger 32 is located is discommunicated. The first port 41 of the reversing unit 4 is communicated with the fourth port 44, and the third port 43 is communicated with the second port 42. It circulates in a way that the refrigerant flows through in sequence the outlet 22 of the compressor 2, the first port 41 and the fourth port 44 of the reversing unit 4, the phase-change thermal-storage heat exchanger 1, the first throttling element 63, the first heat exchanger 31, the second port 42 and the third port 43 of the reversing unit 4, and finally returns from the inlet 21 of the compressor 2 into the compressor 2. At this time, the first heat exchanger 31 is an evaporator, and the phase-change thermal-storage heat exchanger 1 is a condenser. When the refrigerant flows through the phase-change thermal-storage heat exchanger 1, it performs heat exchange with the phase change medium. The heat emitted by the refrigerant is absorbed and stored by the phase change medium. The state of the phase change medium changes, for example, it can change from a solid state to a liquid state. When the refrigerant flows through the first heat exchanger 31, it performs heat exchange with the air and absorbs the heat in the air to achieve the purpose of cooling.

During the cooling operation of the air conditioner, the phase change medium absorbs and stores the condensation heat, and its state changes from solid to liquid. When the phase change medium is completely changed to a liquid state, its heat storage capacity reaches the upper limit. At this time, the air conditioner cannot continue to perform cooling. The air conditioner needs to start a first regeneration process to restore the heat storage capacity of the phase change medium. Of course, when the phase change medium is not completely converted to a liquid state, if the cooking is completed, the first regeneration process may also be started to maximize the heat storage capacity of the phase-change thermal-storage heat exchanger 1. This process is similar to battery charging, which can change the phase change medium from a liquid state to a solid state in a short time, and restore the heat storage capacity so that the air conditioner can continue to perform cooling.

The first regeneration process of the phase change medium is realized by stopping the refrigeration cycle of the air conditioner and then starting the first reheat cycle of the air conditioner. The heat exchange branch where the first heat exchanger 31 is located is discommunicated, and the heat exchange branch where the second heat exchanger 32 is located is communicated. The direction of the refrigerant flow can be switched by the reversing unit 4. The first port 41 of the reversing unit 4 is communicated with the second port 42, and the third port 43 is communicated with the fourth port 44. In this process, it circulates in a way that the refrigerant flows through in sequence the outlet 22 of the compressor 2, the first port 41 and the second port 42 of the reversing unit 4, the second heat exchanger 32, the second throttling element 66, the phase change heat storage exchanger 1, the fourth port 44 and the third port 43 of the reversing unit 4, and finally returns from the inlet 21 of the compressor 2 into the compressor 2. At this time, the phase-change thermal-storage heat exchanger 1 is an evaporator, and the second heat exchanger 32 is a condenser. When the refrigerant flows through the phase-change thermal-storage heat exchanger 1, the refrigerant exchanges heat with the phase change medium. The refrigerant absorbs heat stored in the phase change medium. The state of the phase change medium changes, for example, from a liquid state to a solid state. When the refrigerant flows through the second heat exchanger 32, it performs heat exchange with the water in the water tank 33 to release heat to the water, thereby achieving the purpose of making hot water. In this way, while making full use of the energy storage characteristics of the phase change material, energy efficiency is improved, and energy conservation and environmental protection are improved.

It should be noted that this air conditioning system is more suitable for making hot water in summer conditions, and is more suitable for independent kitchens. Because the independent kitchens are relatively closed, the indoor temperature in winter can basically meet the needs of the human body, so the air conditioning heating system in winter can be omitted.

According to the air conditioning system in the embodiment of the present disclosure, the phase-change thermal-storage heat exchanger 1 is used, and it is not necessary to release heat to the environment during cooling and absorb heat from the environment during heating. In addition, hot water can be made by fully utilizing the energy storage characteristics of the phase change material. Therefore, the energy efficiency is improved, and energy saving and environmental protection are more effective.

According to the air conditioner of the embodiment of the present disclosure, there is no need to release heat to the environment during cooling, and there is no need to absorb heat from the environment during heating. An integrated design is realized. After cooling, it can also obtain hot water, which has high energy efficiency.

As shown in FIG. 26, an air conditioning system according to a preferred embodiment of the present disclosure includes a first heat exchange branch and a second heat exchange branch. The first heat exchange branch and the second heat exchange branch are communicated in parallel between the other end of the phase-change thermal-storage heat exchanger 1 and the second port 42. When the first heat exchange branch is communicated, the second heat exchange branch is discommunicated, and when the second heat exchange branch is communicated, the first heat exchange branch is discommunicated.

As shown in FIG. 26, the first heat exchange branch includes a first shut-off valve 71, a first heat exchanger 31, a first throttling element 63, a first check valve 61 and a first drying filter 62. The first shut-off valve 71, the first heat exchanger 31, the first throttling element 63 and the first check valve 61 are communicated in series. The first shut-off valve 71 is communicated between one end of the first heat exchanger 31 and the second port 42. The first check valve 61 is communicated in series with the first throttling element 63 to make the first heat exchange branch unidirectionally conduct from the other end of the phase-change thermal-storage heat exchanger 1 to the second port 42. The first throttling element 63 is communicated between the first heat exchanger 31 and the first check valve 61. The first heat exchange branch also includes the first drying filter 62 communicated in series in the branch. The first drying filter 62 is communicated between the first check valve 61 and the first throttling element 63.

Specifically, in the first heat exchange branch, the first shut-off valve 71, the first heat exchanger 31, the first throttling element 63, the first drying filter 62 and the first check valve 61 are sequentially communicated in series. The first shut-off valve 71 is communicated with the second port 42. The first check valve 61 is communicated with the other end (for example, a lower end in FIGS. 26 to 28) of the phase-change thermal-storage heat exchanger 1. When the first shut-off valve 71 is opened, the first heat exchange branch is communicated to the entire refrigeration cycle, the first drying filter 62 is used to absorb the moisture in the refrigerant, and the first check valve 61 allows the refrigerant to unidirectionally flow from the other end of the phase-change thermal-storage heat exchanger 1 to the first drying filter 62.

As shown in FIG. 26, the second heat exchange branch includes a second shut-off valve 72, a second heat exchanger 32, a second throttling element 66, a second check valve 64 and a second drying filter 65. The second shut-off valve 72, the second heat exchanger 32, the second throttling element 66 and the second check valve 64 are communicated in series. The second shut-off valve 72 is communicated between one end of the second heat exchanger 32 and the second port 42. The second check valve 64 is communicated in series with the second throttling element 66 to make the second heat exchange branch unidirectionally conduct from the second port 42 to the other end of the phase-change thermal-storage heat exchanger 1. The second check valve 64 is communicated between the second heat exchanger 32 and the second throttling element 66. The second heat exchange branch also includes a second drying filter 65 communicated in series in the branch. The second drying filter 65 is communicated between the second check valve 64 and the second throttling element 66.

Specifically, in the second heat exchange branch, the second shut-off valve 72, the second heat exchanger 32, the second check valve 64, the second drying filter 65 and the second throttling element 66 are sequentially communicated in series. The second shut-off valve 72 is communicated with the second port 42. The second throttling element 66 is communicated with the other end (for example, the lower end in FIGS. 26 to 28) of the phase-change thermal-storage heat exchanger 1. When the second shut-off valve 72 is opened, the second heat exchange branch is communicated to the entire refrigeration cycle, the second drying filter 65 is used to absorb the moisture in the refrigerant, and the second check valve 64 allows the refrigerant to unidirectionally flow from the second heat exchanger 32 to the second drying filter 65.

Alternatively, the first throttling element 63 and the second throttling element 66 may be capillary tubes, thermal expansion valves, electronic expansion valves, or the like. The first shut-off valve 71 and the second shut-off valve 72 may be solenoid valves, ball valves, or the like.

When the air conditioning system is operating in a cooling mode, the first shut-off valve 71 is opened, the second shut-off valve 72 is closed, and the first heat exchange branch is communicated. The first port 41 of the reversing unit 4 is communicated with the fourth port 44, and the third port 43 is communicated with the second port 42. It circulates in a way that the refrigerant flows through in sequence the outlet 22 of the compressor 2, the first port 41 and the fourth port 44 of the reversing unit 4, the phase-change thermal-storage heat exchanger 1, the first check valve 61, the first drying filter 62, the first throttling element 63, the first heat exchanger 31, the first shut-off valve 71, the second port 42 and the third port 43 of the reversing unit 4, and finally returns from the inlet 21 of the compressor 2 to the compressor 2. Among them, the refrigerant flows through the first heat exchanger 31 to exchange heat with the air so as to achieve refrigeration.

After the cooling is completed, the first reheat cycle of the air conditioner is started, the first shut-off valve 71 is closed, the second shut-off valve 72 is opened, and the second heat exchange branch is communicated. The first port 41 of the reversing unit 4 is communicated with the second port 42, and the third port 43 is communicated with the fourth port 44. It circulates in a way that the refrigerant flows through in sequence the outlet 22 of the compressor 2, the first port 41, the second port 42, the second shut-off valve 72, the second heat exchanger 32, the second check valve 64, and the second drying filter 65, the second throttling element 66, the phase-change thermal-storage heat exchanger 1, the fourth port 44 and the third port 43 of the reversing unit 4, and finally returns from the inlet 21 of the compressor 2 to the compressor 2. Among them, the refrigerant flows through the second heat exchanger 32 to exchange heat with the water in the water tank 33 to obtain hot water.

As shown in FIG. 27, an air conditioning system according to another preferred embodiment of the present disclosure includes a first heat exchange branch and a second heat exchange branch. The first heat exchange branch and the second heat exchange branch are communicated in parallel between the other end of the phase-change thermal-storage heat exchanger 1 and the second port 42. When the first heat exchange branch is communicated, the second heat exchange branch is discommunicated. When the second heat exchange branch is communicated, the first heat exchange branch is discommunicated.

As shown in FIG. 27, the first heat exchange branch includes a first shut-off valve 71, a first heat exchanger 31, a first throttle branch and a third throttle branch. The first shut-off valve 71 and the first heat exchanger 31 are communicated in series. The first shut-off valve 71 is communicated between one end of the first heat exchanger 31 and the second port 42. The first throttle branch and the third throttle branch are communicated in parallel between the first heat exchanger 31 and the other end (for example, a lower end in FIG. 27) of the phase-change thermal-storage heat exchanger 1.

The first throttle branch includes a first throttling element 63, a first check valve 61 and a first drying filter 62. The first throttling element 63, the first check valve 61 and the first drying filter 62 are communicated in series. The first check valve 61 is communicated in series with the first throttling element 63 to make the first heat exchange branch unidirectionally conduct from the other end of the phase-change thermal-storage heat exchanger 1 to the second port 42. The first throttling element 63 is communicated between the first heat exchanger 31 and the first check valve 61. The first heat exchange branch also includes the first drying filter 62 communicated in series in the branch. The first drying filter 62 is communicated between the first check valve 61 and the first throttling element 63.

The third throttle branch includes a third throttling element 69, a third check valve 67 and a third drying filter 68. The third throttling element 69, the third check valve 67 and the third drying filter 68 are communicated in series. The third check valve 67 is communicated in series with the third throttling element 69. The third throttle branch is unidirectionally conducted from the other end of the first heat exchanger 31 to the other end of the phase-change thermal-storage heat exchanger 1. The third check valve 67 is communicated between the first heat exchanger 31 and the third throttling element 69. The third heat exchange branch also includes the third drying filter 68 communicated in series in the branch. The third drying filter 68 is communicated between the third check valve 67 and the third throttling element 69.

Specifically, in the first heat exchange branch, the first shut-off valve 71, the first heat exchanger 31 and the first throttle branch are sequentially communicated in series. The first shut-off valve 71, the first heat exchanger 31 and the third throttle branch are sequentially communicated in series. The first shut-off valve 71 is communicated with the second port 42. In the first throttle branch, the first throttling element 63, the first drying filter 62 and the first check valve 61 are sequentially communicated in series, and the first throttling element 63 is communicated with the first heat exchanger 31. The first check valve 61 is communicated with the other end (for example, the lower end in FIG. 27) of the phase-change thermal-storage heat exchanger 1. In the third throttle branch, the third check valve 67, the third drying filter 68 and the third throttling element 69 are sequentially communicated in series, and the third check valve 67 is communicated with the first heat exchanger 31. The third throttling element 69 is communicated with the other end (for example, the lower end in FIG. 27) of the phase-change thermal-storage heat exchanger 1. When the first shut-off valve 71 is opened, the first heat exchange branch is communicated to the entire refrigeration cycle, and the first drying filter 62 or the third drying filter 68 is used to absorb moisture in the refrigerant.

As shown in FIG. 27, the second heat exchange branch includes a second shut-off valve 72, a second heat exchanger 32, a second throttling element 66, a second check valve 64 and a second drying filter 65. The second shut-off valve 72, the second heat exchanger 32, the second throttling element 66 and the second check valve 64 are communicated in series. The second shut-off valve 72 is communicated between one end of the second heat exchanger 32 and the second port 42. The second check valve 64 is communicated in series with the second throttling element 66 to make the second heat exchange branch unidirectionally conduct from the second port 42 to the other end of the phase-change thermal-storage heat exchanger 1. The second check valve 64 is communicated between the first heat exchanger 31 and the second throttling element 66. The second heat exchange branch also includes the second drying filter 65 connected in series in the branch. The second drying filter 65 is communicated between the second check valve 64 and the second throttling element 66.

Specifically, in the second heat exchange branch, the second shut-off valve 72, the second heat exchanger 32, the second check valve 64, the second drying filter 65 and the second throttling element 66 are sequentially communicated in series. The second shut-off valve 72 is communicated with the second port 42. The second throttling element 66 is communicated with the other end (for example, the lower end in FIG. 27) of the phase-change thermal-storage heat exchanger 1. When the second shut-off valve 72 is opened, the second heat exchange branch is communicated to the entire refrigeration cycle. The second drying filter 65 is used to absorb moisture in the refrigerant. The second check valve 64 allows the refrigerant to unidirectionally flow from the second heat exchanger 32 to the second drying filter 65.

Alternatively, the first throttling element 63, the second throttling element 66 and the third throttling element 69 may be capillaries, thermal expansion valves, or electronic expansion valves etc. The first shut-off valve 71 and the second shut-off valve 72 may be solenoid valves, ball valves, or the like.

When the air conditioning system is operating in a cooling mode, the first shut-off valve 71 is opened, the second shut-off valve 72 is closed, and the first heat exchange branch is communicated. The first port 41 of the reversing unit 4 is communicated with the fourth port 44, and the third port 43 is communicated with the second port 42. It circulates in a way that the refrigerant flows through in sequence the outlet 22 of the compressor 2, the first port 41 and the fourth port 44 of the reversing unit 4, the phase-change thermal-storage heat exchanger 1, the first check valve 61, the first drying filter 62, the first throttling element 63, the first heat exchanger 31, the first shut-off valve 71, the second port 42 and the third port 43 of the reversing unit 4, and finally returns from the inlet 21 of the compressor 2 to the compressor 2. Among them, the refrigerant flows through the first heat exchanger 31 to exchange heat with the air so as to achieve refrigeration.

After the cooling is completed, the first reheat cycle of the air conditioner is started, the first shut-off valve 71 is closed, the second shut-off valve 72 is opened, and the second heat exchange branch is communicated. The first port 41 of the reversing unit 4 is communicated with the second port 42, and the third port 43 is communicated with the fourth port 44. It circulates in a way that the refrigerant flows through in sequence the outlet 22 of the compressor 2, the first port 41, the second port 42, the second shut-off valve 72, the second heat exchanger 32, the second check valve 64, and the second drying filter 65, the second throttling element 66, the phase-change thermal-storage heat exchanger 1, the fourth port 44 and the third port 43 of the reversing unit 4, and finally returns from the inlet 21 of the compressor 2 to the compressor 2. Among them, the refrigerant flows through the second heat exchanger 32 to exchange heat with the water in the water tank 33 to obtain hot water.

When the air conditioner is operating for heating, the first shut-off valve 71 is opened, the second shut-off valve 72 is closed, and the first heat exchange branch is communicated. The first port 41 of the reversing unit 4 is communicated with the second port 42, and the third port 43 is communicated with the fourth port 44. It circulates in a way that the refrigerant flows through in sequence the outlet 22 of the compressor 2, the first port 41 and the second port 42 of the reversing unit 4, the first heat exchanger 31, the third check valve 67, the third drying filter 68, the third throttling element 69, the phase-change thermal-storage heat exchanger 1, the fourth port 44 and the third port 43 of the reversing unit 4, and finally returns to the compressor 2 from the inlet 21 of the compressor 2. At this time, the phase-change thermal-storage heat exchanger 1 is an evaporator, and the first heat exchanger 31 is a condenser. When the refrigerant flows through the phase-change thermal-storage heat exchanger 1, the refrigerant exchanges heat with the phase change medium, and the refrigerant absorbs the heat stored in the phase change medium. The state of the phase change medium changes, for example, from a liquid state to a solid state. When the refrigerant flows through the first heat exchanger 31, it performs heat exchange with the air to release heat to the air, thereby achieving the purpose of heating.

Similarly, during the heating operation of the air conditioner, the phase change medium changes from a liquid state to a solid state because the refrigerant absorbs heat from the phase change medium. When the phase change medium is completely converted to the solid state, its heat release capacity reaches the upper limit, and the air conditioning system cannot continue to perform heating at this time. The air conditioning system needs to start a second regeneration process to restore the heat release capacity of the phase change medium. Of course, when the phase change medium is not completely converted to the solid state, if the cooking is completed, the second regeneration process may also be started to maximize the heat release capacity of the phase-change thermal-storage heat exchanger 1. The second regeneration process is opposite to the above-mentioned first regeneration process, which can change the phase change medium from a solid state to a liquid state in a short time, and restore the heat release capability, so that the air conditioner can continue to perform heating. This is achieved by stopping the heating cycle of the air conditioner and starting the refrigeration cycle of the air conditioner. The first shut-off valve 71 is opened, the second shut-off valve 72 is closed, and the first heat exchange branch is communicated. The first port 41 of the reversing unit 4 is communicated with the fourth port 44, and the third port 43 is communicated with the second port 42. It circulates in a way that the refrigerant flows through in sequence the outlet 22 of the compressor 2, the first port 41 and the fourth port 44 of the reversing unit 4, the phase-change thermal-storage heat exchanger 1, the first check valve 61, the first drying filter 62, the first throttling element 63, the first heat exchanger 31, the first shut-off valve 71, the second port 42 and the third port 43 of the reversing unit 4, and finally returns to the compressor 2 from the inlet 21 of the compressor 2. In this process, the phase change medium absorbs and stores the heat of condensation, and changes from a solid state to a liquid state, thereby restoring heat release capability. This second regeneration process is usually started when the air conditioner does not require heating. Because cold air will be released during the second regeneration process, doors and windows which are communicated the space where the air conditioner is located with indoor rooms shall be closed to prevent the cold air from entering other spaces in the room. Windows communicating the space where the air conditioner is located and the outdoor can be opened for air circulation. Of course, when the air conditioner is a portable air conditioner, the above process can be performed outdoors to avoid the cold air from the air conditioner from affecting the indoor air condition.

The air conditioning system having the above-mentioned structure can perform cooling in summer and heating in winter, and can be used in both closed kitchens and open kitchens.

As shown in FIG. 28, an air conditioning system according to another preferred embodiment of the present disclosure includes a first heat exchange branch, a second heat exchange branch, and a third shut-off valve 73. The first heat exchange branch and the second heat exchange branch are communicated in parallel between the other end of the phase-change thermal-storage heat exchanger 1 and the second port 42. When the first heat exchange branch is communicated, the second heat exchange branch is discommunicated, and when the second heat exchange branch is communicated, the first heat exchange branch is discommunicated.

As shown in FIG. 28, the first heat exchange branch includes a first shut-off valve 71, a first heat exchanger 31, a first throttling element 63, a first check valve 61 and a first drying filter 62. The first shut-off valve 71, the first heat exchanger 31, the first throttling element 63 and the first check valve 61 are communicated in series. The first shut-off valve 71 is communicated between one end of the first heat exchanger 31 and the second port 42. The first check valve 61 is communicated in series with the first throttling element 63 to make the first heat exchange branch unidirectionally conduct from the other end of the phase-change thermal-storage heat exchanger 1 to the second port 42. The first throttling element 63 is communicated between the first heat exchanger 31 and the first check valve 61. The first heat exchange branch also includes the first drying filter 62 communicated in series in the branch. The first drying filter 62 is communicated between the first check valve 61 and the first throttling element 63.

Specifically, in the first heat exchange branch, the first shut-off valve 71, the first heat exchanger 31, the first throttling element 63, the first drying filter 62 and the first check valve 61 are sequentially communicated in series. The first shut-off valve 71 is communicated with the second port 42. The first check valve 61 is communicated with the other end (for example, a lower end in FIG. 28) of the phase-change thermal-storage heat exchanger 1. When the first shut-off valve 71 is opened, the first heat exchange branch is communicated to the entire refrigeration cycle. The first drying filter 62 is used to absorb moisture in the refrigerant. The first check valve 61 allows the refrigerant to unidirectionally flow from the other end of the phase-change thermal-storage heat exchanger 1 to the first drying filter 62.

As shown in FIG. 28, the second heat exchange branch includes a second shut-off valve 72, a second heat exchanger 32, a second throttling element 66, a second check valve 64 and a second drying filter 65. The second shut-off valve 72, the second heat exchanger 32, the second throttling element 66 and the second check valve 64 are communicated in series. The second shut-off valve 72 is communicated between one end of the second heat exchanger 32 and the second port 42. The second check valve 64 is communicated in series with the second throttling element 66 to make the second heat exchange branch unidirectionally conduct from the second port 42 to the other end of the phase-change thermal-storage heat exchanger 1. The second check valve 64 is communicated between the first heat exchanger 31 and the second throttling element 66. The second heat exchange branch also includes the second drying filter 65 connected in series in the branch. The second drying filter 65 is communicated between the second check valve 64 and the second throttling element 66.

Specifically, in the second heat exchange branch, the second shut-off valve 72, the second heat exchanger 32, the second check valve 64, the second drying filter 65 and the second throttling element 66 are sequentially communicated in series. The second shut-off valve 72 is communicated with the second port 42. The second throttling element 66 is communicated with the other end (for example, the lower end in FIG. 28) of the phase-change thermal-storage heat exchanger 1. When the second shut-off valve 72 is opened, the second heat exchange branch is communicated to the entire refrigeration cycle, the second drying filter 65 is used to absorb the moisture in the refrigerant, and the second check valve 64 allows the refrigerant to unidirectionally flow from the second heat exchanger 32 to the second drying filter 65.

Two ends of the third shut-off valve 73 are communicated with the other end of the first heat exchanger 31 and the other end of the second heat exchanger 32, respectively.

Alternatively, the first throttling element 63 and the second throttling element 66 may be capillary tubes, thermal expansion valves, electronic expansion valves, or the like. The first shut-off valve 71 and the second shut-off valve 72 may be solenoid valves, ball valves, or the like.

When the air conditioning system is operating in refrigeration, the first shut-off valve 71 is opened, the second shut-off valve 72 and the third shut-off valve 73 are closed, and the first heat exchange branch is communicated. The first port 41 of the reversing unit 4 is communicated with the fourth port 44, and the third port 43 is communicated with the second port 42. It circulates in a way that the refrigerant flows through in sequence the outlet 22 of the compressor 2, the first port 41 and the fourth port 44 of the reversing unit 4, the phase-change thermal-storage heat exchanger 1, the first check valve 61, the first drying filter 62, the first throttling element 63, the first heat exchanger 31, the first shut-off valve 71, the second port 42 and the third port 43 of the reversing unit 4, and finally returns to the compressor 2 from the inlet 21 of the compressor 2. Among them, the refrigerant flows through the first heat exchanger 31 to exchange heat with the air to achieve cooling.

After the cooling is completed, the first reheat cycle of the air conditioner is started, the first shut-off valve 71 and the third shut-off valve 73 are closed, the second shut-off valve 72 is opened, and the second heat exchange branch is communicated. The first port 41 of the reversing unit 4 is communicated with the second port 42, and the third port 43 is communicated with the fourth port 44. It circulates in a way that the refrigerant flows through in sequence the outlet 22 of the compressor 2, the first port 41, the second port 42, the second shut-off valve 72, the second heat exchanger 32, the second check valve 64, the second drying filter 65, the second throttling element 66, the phase-change thermal-storage heat exchanger 1, the fourth port 44 and the third port 43 of the reversing unit 4, and finally returns to the compressor from the inlet 21 of the compressor 2. Among them, the refrigerant flows through the second heat exchanger 32 to exchange heat with the water in the water tank 33 to obtain hot water.

When the air conditioner is operating for heating, the first shut-off valve 71 and the third shut-off valve 73 are opened, and the second shut-off valve 72 is closed. The first port 41 of the reversing unit 4 is communicated with the second port 42, and the third port 43 is communicated with the fourth port 44. It circulates in a way that the refrigerant flows through in sequence the outlet 22 of the compressor 2, the first port 41 and the second port 42 of the reversing unit 4, the first heat exchanger 31, the third shut-off valve 73, the second check valve 64, the second drying filter 65, the second throttling element 66, the phase-change thermal-storage heat exchanger 1, the fourth port 44 and the third port 43 of the reversing unit 4, and finally returns to the compressor 2 from the inlet 21 of the compressor 2. At this time, the phase-change thermal-storage heat exchanger 1 is an evaporator, and the first heat exchanger 31 is a condenser. When the refrigerant flows through the phase-change thermal-storage heat exchanger 1, the refrigerant exchanges heat with the phase change medium. The refrigerant absorbs the heat stored in the phase change medium, and the state of the phase change medium changes, for example, from a liquid state to a solid state. When the refrigerant flows through the first heat exchanger 31, it performs heat exchange with the air to release heat to the air, thereby achieving the purpose of heating.

Similarly, during the heating operation of the air conditioner, the phase change medium changes from a liquid state to a solid state because the refrigerant absorbs heat from the phase change medium. When the phase change medium is completely converted to the solid state, its heat release capacity reaches the upper limit, and the air conditioning system cannot continue to perform heating at this time. The air conditioning system needs to start a second regeneration process to restore the heat release capacity of the phase change medium. Of course, when the phase change medium is not completely converted to the solid state, if the cooking is completed, the second regeneration process may also be started to maximize the heat release capacity of the phase-change thermal-storage heat exchanger 1. The second regeneration process is opposite to the above-mentioned first regeneration process, which can change the phase change medium from a solid state to a liquid state in a short time, and restore the heat release capability, so that the air conditioner can continue to perform heating. This is achieved by stopping the heating cycle of the air conditioner and starting the refrigeration cycle of the air conditioner. The first shut-off valve 71 is opened, the second shut-off valve 72 and the third shut-off valve are closed, and the first heat exchange branch is communicated. The first port 41 of the reversing unit 4 is communicated with the fourth port 44, and the third port 43 is communicated with the second port 42. It circulates in a way that the refrigerant flows through in sequence the outlet 22 of the compressor 2, the first port 41 and the fourth port 44 of the reversing unit 4, the phase-change thermal-storage heat exchanger 1, the first check valve 61, the first drying filter 62, the first throttling element 63, the first heat exchanger 31, the first shut-off valve 71, the second port 42 and the third port 43 of the reversing unit 4, and finally returns to the compressor 2 from the inlet 21 of the compressor 2. In this process, the phase change medium absorbs and stores the heat of condensation, and changes from a solid state to a liquid state, thereby restoring heat release capability. This second regeneration process is usually started when the air conditioner does not require heating. Because cold air will be released during the second regeneration process, doors and windows which are communicated the space where the air conditioner is located with indoor rooms shall be closed to prevent the cold air from entering other spaces in the room. Windows communicating the space where the air conditioner is located and the outdoor can be opened for air circulation. Of course, when the air conditioner is a portable air conditioner, the above process can be performed outdoors to avoid the cold air from the air conditioner from affecting the indoor air condition.

The air conditioning system having the above-mentioned structure can perform cooling in summer and heating in winter, and can be used in both closed kitchens and open kitchens. The overall number of valves in the system is small, thereby simplifying the system.

In the description of this specification, referring to the descriptions of the terms "one embodiment", "some embodiments", "illustrated embodiments", "examples", "specific examples", or "some examples", etc., mean that in combination with specific features, structures, materials or characteristics described in the embodiments or examples are included in at least one embodiment or example of the present disclosure. In this specification, the schematic expressions of the above terms do not necessarily refer to the same embodiment or example. Moreover, the particular features, structures, materials or characteristics described may be combined in any suitable manner in any one or more embodiments or examples.

Although the embodiments of the present disclosure have been shown and described, those of ordinary skill in the art can understand that various changes, modifications, replacements and variations can be made to these embodiments without departing from the principles and spirit of the present disclosure. The scope of the present disclosure is defined by claims and their equivalents.

What is claimed is:

1. An air conditioner comprising: a compressor, a first heat exchanger, a phase-change thermal-storage heat exchanger, a throttling device and a box;

one of a first end of the first heat exchanger and a first end of the phase-change thermal-storage heat exchanger being communicated with an outlet of the compressor, and a remaining one of the first end of the first heat exchanger and the first end of the phase-change thermal-storage heat exchanger being communicated with an inlet of the compressor;

the throttling device being provided between a second end of the first heat exchanger and a second end of the phase-change thermal-storage heat exchanger;

the box comprising an air supply port and an air return port;

the compressor, the first heat exchanger, the phase-change thermal-storage heat exchanger and the throttling device being mounted in the box;

wherein the air conditioner further comprises a temperature sensor, a human body sensor and a control module, the phase-change thermal-storage heat exchanger comprises a first sensor adapted to detect one-phase content of a phase change medium; the first sensor, the temperature sensor, the human body sensor and the compressor are electrically connected to the control module, and the temperature sensor is adapted to detect ambient temperature.

2. The air conditioner according to claim 1, further comprising a reversing unit which comprises a first port, a second port, a third port and a fourth port, the outlet of the compressor being communicated with the first port, the inlet of the compressor being communicated with the third port, the first end of the first heat exchanger being communicated with the second port, and the first end of the phase-change thermal-storage heat exchanger being communicated with the fourth port.

3. The air conditioner according to claim 1, wherein there are a plurality of temperature sensors, and the plurality of temperature sensors are spaced apart from each other and distributed in the box.

4. The air conditioner according to claim 3, wherein at least one of the plurality of temperature sensors is installed at the air supply port of the air conditioner.

5. The air conditioner according to claim 1, wherein the box comprises a box body with a top opening and a top cover closes the top opening of the box body, the top cover being provided with a plurality of lugs adapted for being mounted to a roof or a ceiling with the air supply port facing to the ground.

6. The air conditioner according to claim 1, wherein the box is provided with a plurality of lugs which are adapted to suspend the box on a side wall.

7. The air conditioner according to claim 1, wherein the air conditioner is a desktop air conditioner which comprises a handle portion provided at the box.

8. The air conditioner according to claim 1, wherein the air supply port and the air return port are located on a same side of the box or on different sides of the box.

9. A control strategy of an air conditioner which comprises:

a compressor, a first heat exchanger, a phase-change thermal-storage heat exchanger, a throttling device and a box, a temperature sensor, a human body sensor and a control module;

one of a first end of the first heat exchanger and a first end of the phase-change thermal-storage heat exchanger being communicated with an outlet of the compressor, and a remaining one of the first end of the first heat exchanger and the first end of the phase-change thermal-storage heat exchanger being communicated with an inlet of the compressor;

the phase-change thermal-storage heat exchanger comprising a first sensor adapted to detect one-phase content of a phase change medium;

the throttling device being provided between a second end of the first heat exchanger and a second end of the phase-change thermal-storage heat exchanger;

the box comprising an air supply port and an air return port;

the compressor, the first heat exchanger, the phase-change thermal-storage heat exchanger and the throttling device being mounted in the box;

the first sensor, the temperature sensor, the human body sensor and the compressor being electrically connected to the control module, the temperature sensor being adapted to detect ambient temperature;

the control strategy of the air conditioner comprising following steps:

S1, determining whether the air conditioner is running;

S21, if the air conditioner is running, determining whether there are any people around the air conditioner;

S31*a*, if there are no people around the air conditioner, determining whether a time without people around exceeds a predetermined time;

S41*a*, if the time without people around exceeds the predetermined time, determining whether the ambient temperature reaches a set value;

S51*a*, if the ambient temperature reaches the set value, turning off the air conditioner, detecting the one-phase content of the phase change medium of the phase-change thermal-storage heat exchanger, and determining whether the one-phase content of the phase change medium is less than a first predetermined volume; and S61*a*, if the one-phase content of the phase change medium is less than the first predetermined volume, starting a regeneration cycle of the air conditioner; and when the one-phase content of the phase change medium is greater than a second predetermined volume, turning off the regeneration cycle of the air conditioner.

10. The control strategy of the air conditioner according to claim 9, further comprising a step after the step S21:

S31*b*, if there are any people around the air conditioner, then detecting the one-phase content of the phase change medium; and when the one-phase content of the phase change medium is less than the first predetermined volume, prompting a user that the one-phase content of the phase change medium is insufficient.

11. The control strategy of the air conditioner according to claim 9, wherein in the step S31*a*, if the time without people around does not exceed the predetermined time, then returning to the step S1;

in the step S41*a*, if the ambient temperature does not reach the set value, returning to the step S1;

in the step S51*a*, if the one-phase content of the phase change medium is not less than the first predetermined volume, returning to the step S1;

after the step S61*a*, returning to the step S1.

12. The control strategy of the air conditioner according to claim 9, further comprising following steps after the step S1:

S22, if the air conditioner is not running, determining whether there are any people around the air conditioner;

S32*a*, if there are no people around the air conditioner, detecting the one-phase content of the phase change medium of the phase-change thermal-storage heat exchanger, and determining whether the one-phase content of the phase change medium is less than the first predetermined volume;

if the one-phase content of the phase change medium is less than the first predetermined volume, executing the step S61*a;* if the one-phase content of the phase change medium is not less than the first predetermined volume, returning to the step S1.

13. The control strategy of the air conditioner according to claim 12, further comprising following steps after the step S22:

S32*b*, if there are people around the air conditioner and the ambient temperature reaches the predetermined value, detecting the one-phase content of the phase change medium;

S33*b*, when the one-phase content of the phase change medium is less than the first predetermined volume, prompting a user that the one-phase content of the phase change medium is insufficient, and returning to the step S1; when the one-phase content of the phase change medium is not less than the first predetermined volume, prompting the user to turn on the air conditioner.

14. The control strategy of the air conditioner according to claim 12, wherein the air conditioner is a portable air conditioner, and the control strategy further comprises a step after the step S22:

S32*c*, if there are people around the air conditioner, detecting the one-phase content of the phase change medium; when the one-phase content of the phase change medium is less than the first predetermined volume, prompting the user that the one-phase content of the phase change medium is insufficient, and returning to the step S1.

15. An air conditioning system comprising:

a reversing unit comprising a first port, a second port, a third port and a fourth port;

a compressor comprising an inlet being communicated with the third port and an outlet being communicated with the first port;

a first heat exchanger, the first heat exchanger comprising a first end and a second end, the first end of the first heat exchanger being communicated with the second port;

a second heat exchanger and a water tank, the second heat exchanger comprising a third end and a fourth end, the third end of the second heat exchanger being communicated with the second port, and water in the water tank being adapted for heat exchange with the second heat exchanger;

a phase-change thermal-storage heat exchanger; wherein the phase-change thermal-storage heat exchanger comprises a fifth end and a sixth end, the fifth end of the phase-change thermal-storage heat exchanger is communicated with the fourth port and the sixth end of the phase-change thermal-storage heat exchanger is communicated with the second end of the first heat exchanger by a first throttling element, and the sixth end of the phase-change thermal-storage heat exchanger is communicated with the fourth end of the second heat exchanger by a second throttling element; wherein when the air conditioning system is operating under a cooling mode, the first port is communicated with the fourth port; the third port is communicated with the second port; and the fourth port, the phase-change thermal-storage heat exchanger, the first throttling element, the first heat exchanger and the second port are sequentially communicated;

when the air conditioning system is operating a first reheat cycle, the first port is communicated with the second port; the third port is communicated with the fourth port; the second port, the second heat exchanger, the second throttling element, the phase-change thermal-storage heat exchanger and the fourth port are sequentially communicated; and the water in the water tank exchanges heat with the second heat exchanger so as to be heated.

16. The air conditioning system according to claim 15, further comprising a first heat exchange branch and a second heat exchange branch being communicated in parallel between the sixth end of the phase-change thermal-storage heat exchanger and the second port;

the first heat exchange branch comprising a first shut-off valve, the first heat exchanger and the first throttling element being communicated in series;

the second heat exchange branch comprising a second shut-off valve, the second heat exchanger and the second throttling element being communicated in series; wherein when the air conditioning system is operating under the cooling mode, the first heat exchange branch is communicated with the compressor while the second heat exchange branch is discommunicated with the compressor.

17. The air conditioning system according to claim 16, wherein the first heat exchange branch further comprises a first check valve communicated in series with the first throttling element, so that the first heat exchange branch is unidirectionally conducted from the sixth end of the phase-change thermal-storage heat exchanger to the second port; and the second heat exchange branch further comprises a second check valve communicated in series with the second throttling element, so that the second heat exchange branch is unidirectionally conducted from the second port to the sixth end of the phase-change thermal-storage heat exchanger.

18. The air conditioning system according to claim 17, wherein the first throttling element is communicated between the first heat exchanger and the first check valve; and the second check valve is communicated between the second heat exchanger and the second throttling element; or the first heat exchange branch comprises a first throttle branch and a third throttle branch being communicated in parallel, the first throttle branch comprises the first check valve and the first throttling element being communicated in series, the third throttle branch comprises a third check valve and a third throttling element being communicated in series, and the third throttle branch is unidirectionally conducted from the second end of the first heat exchanger to the sixth end of the phase-change thermal-storage heat exchanger; wherein when the air conditioning system is operating under a heating mode, the first port is communicated with the second port; the third port is communicated with the fourth port; the second port, the first shut-off valve, the first heat exchanger, the third check valve, the third throttling element, the phase-change thermal-storage heat exchanger and the fourth port are sequentially communicated.

19. The air conditioning system according to claim 17, further comprising a third shut-off valve of which two ends are communicated with the second end of the first heat exchanger and the fourth end of the second heat exchanger, respectively; wherein when the air conditioning system is operating under a heating mode, the first port is communicated with the second port; the third port is communicated with the fourth port; the second port, the first shut-off valve, the first heat exchanger, the third shut-off valve, the second check valve, the second throttling element, the phase-change thermal-storage heat exchanger and the fourth port are sequentially communicated.

20. The air conditioning system according to claim 18, further comprising a first drying filter communicated between the first throttling element and the first check valve, a second drying filter communicated between the second throttling element and the second check valve, and a third drying filter communicated between the third throttling element and the third check valve.

* * * * *